US008162305B2

(12) United States Patent
Hattori et al.

(10) Patent No.: US 8,162,305 B2
(45) Date of Patent: Apr. 24, 2012

(54) SHEET PROCESSING SYSTEM, SHEET-SUPPLY CONTROL METHOD, AND COMPUTER PROGRAM PRODUCT

(75) Inventors: Hitoshi Hattori, Tokyo (JP); Masahiro Tamura, Kanagawa (JP); Kazuhiro Kobayashi, Kanagawa (JP); Tomohiro Furuhashi, Kanagawa (JP); Hiroshi Maeda, Gifu (JP); Atsushi Kuriyama, Aichi (JP); Akira Kunieda, Tokyo (JP); Ichiro Ichihashi, Aichi (JP); Takashi Saito, Kanagawa (JP); Junichi Tokita, Kanagawa (JP); Naoyuki Ishikawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 184 days.

(21) Appl. No.: 12/656,323

(22) Filed: Jan. 26, 2010

(65) Prior Publication Data

US 2010/0207314 A1 Aug. 19, 2010

(30) Foreign Application Priority Data

Feb. 16, 2009 (JP) ..... 2009-032918

(51) Int. Cl.
*B65H 37/04* (2006.01)

(52) U.S. Cl. ..... 270/58.09; 270/58.07; 270/58.08; 270/52.18

(58) Field of Classification Search ..... 270/37, 270/58.07, 58.08, 58.09, 52.18
See application file for complete search history.

(56) References Cited

U.S. PATENT DOCUMENTS

| | | | | |
|---|---|---|---|---|
| 6,735,415 | B2 * | 5/2004 | Isobe et al. | 399/410 |
| 7,568,688 | B2 | 8/2009 | Nomura et al. | |
| 7,694,966 | B2 * | 4/2010 | Nagasako et al. | 271/303 |
| 2007/0235917 | A1 * | 10/2007 | Nagasako et al. | 270/58.08 |
| 2008/0067730 | A1 | 3/2008 | Suzuki | |
| 2008/0099974 | A1 | 5/2008 | Nomura | |
| 2008/0236351 | A1 | 10/2008 | Hidaka | |
| 2008/0290830 | A1 | 11/2008 | Hattori | |
| 2009/0014949 | A1 | 1/2009 | Ichihashi | |
| 2009/0060604 | A1 | 3/2009 | Hattori | |
| 2009/0066001 | A1 | 3/2009 | Ichihashi | |
| 2009/0066003 | A1 | 3/2009 | Kunieda | |
| 2009/0206547 | A1 | 8/2009 | Tokita | |
| 2009/0283961 | A1 | 11/2009 | Saito | |

FOREIGN PATENT DOCUMENTS

| | | |
|---|---|---|
| JP | 09-255219 | 9/1997 |
| JP | 2002-273705 | 9/2002 |

* cited by examiner

*Primary Examiner* — Leslie A Nicholson, III
(74) *Attorney, Agent, or Firm* — Harness, Dickey & Pierce, P.L.C.

(57) ABSTRACT

A sheet processing system includes a sheet processing device that includes a post-processing unit that performs a predetermined post-processing on a sheet member and a sheet supplying device that supplies the sheet member to the sheet processing device. The post-processing unit has two waiting positions including a first position that is a normal waiting position and a second position that is a position filling items to be used in the post-processing in the post-processing unit. When the post-processing unit moves from the second position to a post-processing position to perform the post-processing in response to a post-processing request, the sheet supplying device sets a supply time for supplying the sheet member to the sheet processing device longer than a time that is required for the sheet processing device to move from the first position to the post-processing position by a predetermined time.

11 Claims, 33 Drawing Sheets

SHEET PROCESSING SYSTEM, SHEET-SUPPLY CONTROL METHOD, AND COMPUTER PROGRAM PRODUCT

CROSS-REFERENCE TO RELATED APPLICATIONS

The present application claims priority to and incorporates by reference the entire contents of Japanese Patent Application No. 2009-032918 filed in Japan on Feb. 16, 2009.

BACKGROUND OF THE INVENTION

1. Field of the Invention

The present invention relates to a sheet processing system that performs predetermined post-processing on sheets (the sheets include recording sheets and transfer sheets) and sheet members, such as OHP transparencies, (hereinafter, "sheets"), a sheet-supply control method that is performed by the sheet processing system, and a computer program product for causing a computer to perform the sheet-supply control method.

2. Description of the Related Art

Japanese Patent Application Laid-open No. H9-255219 and Japanese Patent Application Laid-open No. 2002-273705 disclose typical sheet processing devices each of which includes a post-processing unit that performs predetermined post-processing on sheets. A stapler unit according to the invention disclosed in Japanese Patent Application Laid-open No. H9-255219 includes a stapling unit and a staple receiving unit as separate units, each of which can individually move to a stapling position, which allows for providing a finisher with easy handling while providing a capability to staple various types of sheets and maintain a high copy rate. When "staple empty", which is indicative of a shortage of staples within the staple unit, is detected, the stapling unit returns to a staple replacement position (home position). When a staple jam is detected, the staple receiving unit moves back to a retraction position (home position).

The sheet processing device according to the invention disclosed in Japanese Patent Application Laid-open No. 2002-273705 includes a stapler that is designed in such a manner that a user can manually rotate the stapler only when the stapler is in a position to have its staple cartridge replaced (hereinafter, "staple replacement position"). The sheet processing device includes a unit that moves the stapler along the trailing edge of the sheet with respect to the sheet conveying direction; a unit that supports the stapler in such a manner that the stapler cannot rotate when the stapler is moving along the trailing edge with respect to the sheet conveying direction, while the stapler can rotate at a predetermined position; and a unit that controls the angle that the stapler rotates at the predetermined position. Because the predetermine position corresponds to the staple replacement position, the stapler can rotate only when in the staple replacement position. This improves the efficiency of the staple replacement activity.

It follows that, in a conventional image processing system that includes an image forming apparatus and the above-described sheet processing device (sheet post-processing device) connected to each other, when staple empty (indicative of a shortage of items used in the sheet post-processing device) is detected, the stapler is moved to the staple replacement position so that the user can promptly perform the staple filling operation. Moreover, because the stapler can rotate only when in the staple replacement position, the efficiency of the staple replacement operation is improved.

According to the above-described conventional technology, if staple empty is detected and the stapler is moved to the staple-filling position, actions concerning the stapling process are basically prevented until the stapler is filled with new staples; however, there are cases where it is preferable to keep performing the stapling process under this staple-empty situation. In most cases, notification of staple empty is made when a small number of staples still remain. This is because even after the sheet post-processing device notifies the image forming apparatus of staple empty, because the flow of sheets that have already been subjected to the image processing cannot be stopped, the stapling process needs to be performed several more times and sometimes more than ten times. Therefore, notification of staple empty is made when several tens of staples still remain.

This means that, even after the stapler is moved to the staple-filling position, it is possible to perform the stapling process several tens of times before filling it with new staples. If the stapling process cannot be suspended because of processes performed by the image forming apparatus or if the user needs several stapled sets urgently, it is possible to temporarily permit the actions concerning the stapling process with the risk of the stapler actually becoming staple empty.

Moreover, if staple empty is detected in the course of the stapling process with several sets remaining unprocessed, although, in principal, the stapling process stops temporarily and resumes after the stapler is filled with new staples, if the user cannot perform the staple filling operation immediately, it is possible to continue only the image formation without performing the stapling process before the stapler is filled with new staples. In this case, the user will make an instruction to resume the stapling process later. If the stapling process is not needed, some sheet processing devices can operate even if the stapler is in the staple-filling position; however, the sheet processing devices may not align the sheets precisely when the stapler is in the staple-filling position. In most cases, notification of either "stapling" or "discharge without stapling" has not been made at the start of the first process on the sheet set.

As described above, after notification of staple empty is made and the stapler is moved to the staple-filling position, notification of a stapling resume request (including a request for discharge without stapling) is made, in some cases. If the notification of the stapling resume request is made at the start of the process, the sheet processing device first moves the stapler to a predetermined position depending on the mode of stapling and the sheet size and then receives the sheet. However, the stapler-filling position is set to such a position that the stapler first moves to the normal stapler home position and then moves to the staple-filling position. In the invention disclosed in Japanese Patent Application Laid-open No. 2002-273705, after the stapler is moved to this position, the stapler is rotated so that the user can easily perform the staple replacement from the front side of the sheet post-processing device.

In this case, to move the stapler to the stapling position, it is necessary to rotate the stapler to the previous angle and then move the stapler to the predetermined position. Therefore, it takes a longer time to move the stapler to the stapling position compared with the usual case. That is, the interval increases between when the post-processing device receives notification of the post-processing mode and the sheet size or the like from the image forming apparatus and when the sheet post-processing device is ready to receive the sheet.

Because the time to set the sheet post-processing device ready to receive the sheet is necessary, when the sheet is supplied from the image forming apparatus to the sheet post-processing device, it is necessary for the image forming apparatus to notify the sheet post-processing device of the selected post-processing mode and supply the sheet a specified time Tw after. If the moving of the stapler from the staple-filling position is taken into consideration, there is the necessity to set the specified time Tw to the time that the stapler requires to move from the staple-filling position; therefore, it takes a longer time than usual. In this case, because the interval between the process request and the sheet supply increases, the first copy time also increases.

However, although the first copy time increases, because the increased time corresponds to the short time that is required to move from the staple replacement position to the home position, the conventional sheet processing device sets the specified Tw to either the time required to move from the staple replacement position or the time required to move from the home position. In the latter case, after the staple replacement, the sheet is supplied to the post-processing device after the specified time Tw after the stapler is automatically returned to the home position or a home-position return instruction is received via the control panel.

In the former case, the time required to move from the staple replacement position to the home position is always idle time. In the latter case, a longer time is required compared with the former case because a user operation is inserted after the staple replacement and before resuming the operation.

SUMMARY OF THE INVENTION

It is an object of the present invention to at least partially solve the problems in the conventional technology.

According to one aspect of the present invention, there is provided a sheet processing system including a sheet processing device that includes a post-processing unit that performs a predetermined post-processing on a sheet member and a sheet supplying device that supplies the sheet member to the sheet processing device. The post-processing unit has two waiting positions including a first position that is a normal waiting position and a second position that is a position filling items to be used in the post-processing in the post-processing unit. When the post-processing unit moves from the second position to a post-processing position to perform the post-processing in response to a post-processing request, the sheet supplying device sets a supply time for supplying the sheet member to the sheet processing device longer than a time that is required for the sheet processing device to move from the first position to the post-processing position by a predetermined time.

Furthermore, according to another aspect of the present invention, there is provided a method of controlling a sheet supply in a sheet processing system including a sheet processing device that includes a post-processing unit that performs a predetermined post-processing on a sheet member and a sheet supplying device that supplies the sheet member to the sheet processing device. The post-processing unit has two waiting positions including a first position that is a normal waiting position and a second position that is a position filling items to be used in the post-processing in the post-processing unit. The method includes setting, when the post-processing unit moves from the second position to a post-processing position to perform the post-processing in response to a post-processing request, a supply time for the sheet supplying device to supply the sheet member to the sheet processing device longer than a time that is required for the sheet processing device to move from the first position to the post-processing position by a predetermined time.

Moreover, according to still another aspect of the present invention, there is provided a computer program product including a computer-usable medium having computer-readable program codes embodied in the medium for implementing a method of controlling a sheet supply in a sheet processing system including a sheet processing device that includes a post-processing unit that performs a predetermined post-processing on a sheet member and a sheet supplying device that supplies the sheet member to the sheet processing device. The post-processing unit has two waiting positions including a first position that is a normal waiting position and a second position that is a position filling items to be used in the post-processing in the post-processing unit. The program codes when executed cause a computer to execute setting, when the post-processing unit moves from the second position to a post-processing position to perform the post-processing in response to a post-processing request, a supply time for the sheet supplying device to supply the sheet member to the sheet processing device longer than a time that is required for the sheet processing device to move from the first position to the post-processing position by a predetermined time.

In the following embodiments, the post-processing unit and the stapling unit correspond to a side-stitch stapler S1, the sheet processing device corresponds to a sheet post-processing device PD, a sheet supplying device corresponds to an image forming apparatus PR or a sheet supply device (not shown) of the image forming apparatus PR, the first position corresponds to a home position P2, the second position corresponds to a staple-filling position P1, the post-processing position corresponds to a stapling position P3, the predetermined time corresponds to an additional time Te, the image forming apparatus corresponds to the image forming apparatus PR, and the items used in the post-processing correspond to staples.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
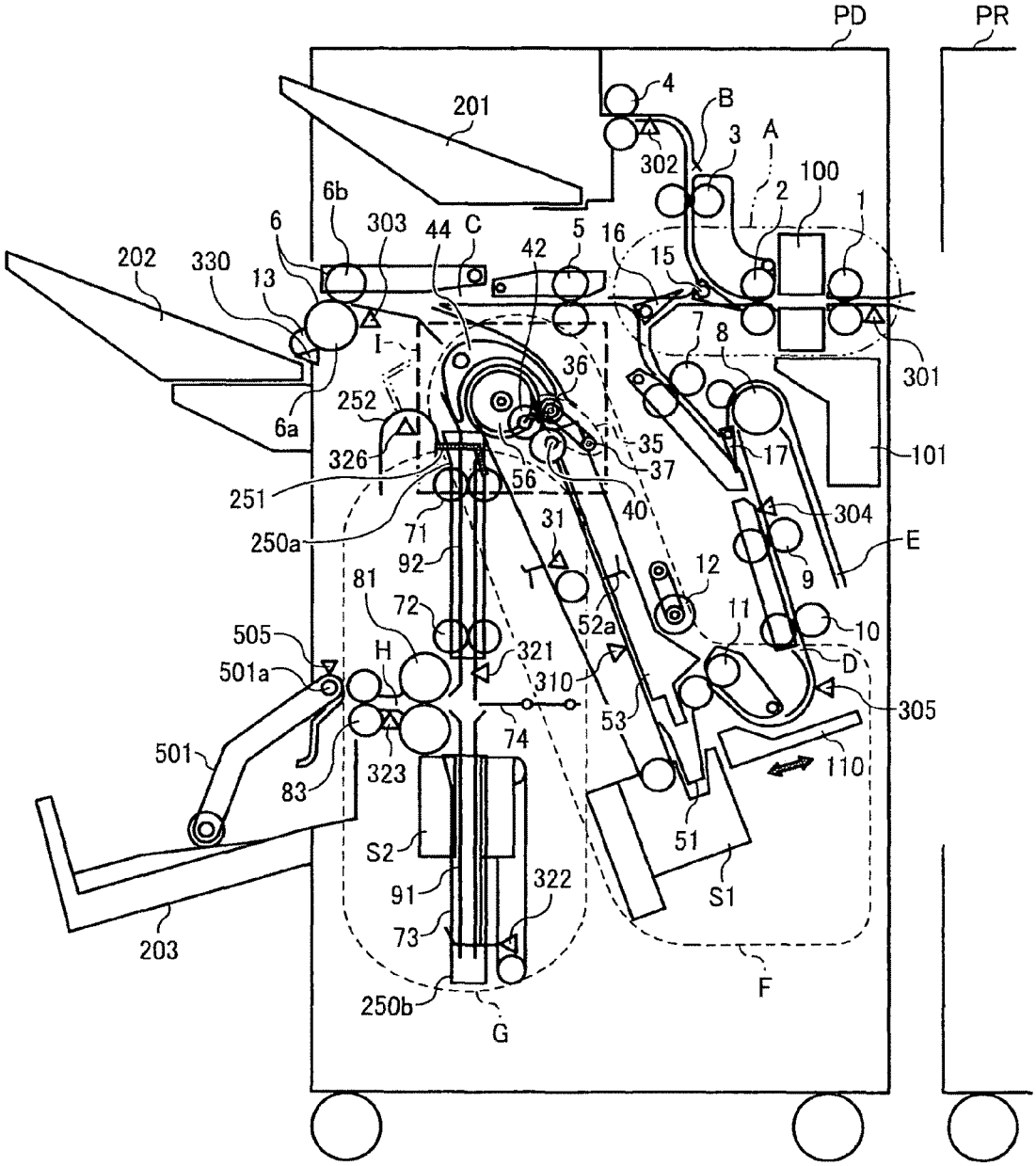
FIG. 1 is a schematic diagram of the general configuration of a system that includes a sheet post-processing device and an image forming apparatus according to an embodiment of the present invention.

FIG. 1 is a schematic diagram of a system that includes a sheet post-processing device PD and an image forming apparatus PR according to an embodiment of the present invention.

As shown in FIG. 1, the sheet post-processing device PD is attached to a side of the image forming apparatus PR in such a manner that a sheet is conveyed from the image forming apparatus PR to the sheet post-processing device PD. The sheet is then conveyed to, by operation of switching claws 15 and 16, any of a conveyance path A near which a post-processing unit that performs post-processing on a single sheet (a punching unit 100 that works as a puncher in the embodiment), a conveyance path B that is downstream of the conveyance path A and leads the sheet to an upper tray 201, a conveyance path C that leads the sheet to a shift tray 202, and a conveyance path D that leads the sheet to a processing tray F that performs post-processing, such as alignment and stapling (hereinafter, "side-stitch tray").

The image forming apparatus PR includes, although the following units are not shown, an image processing circuit that converts received image data to printable image data; an optical writing device that writes an image onto a photosensitive element using a latent image signal received from the image processing circuit; a developing device that develops the latent image formed on the photosensitive element by the optical writing into a toner image; a transferring device that transfers the toner image that is developed by the developing device onto a sheet; and a fixing device that fixes the toner image onto the sheet. The sheet having the fixed toner image is conveyed to the sheet post-processing device PD and is post-processed by the sheet post-processing device PD in a desired manner. Although, as mentioned above, the image forming apparatus PR in the present embodiment is an electrophotographic image forming apparatus, some other well-known image forming apparatuses, such as an inkjet image forming apparatus and a thermal transfer image forming apparatus, can be used, instead. In the present embodiment, the image processing circuit, the optical writing device, the developing device, and the fixing device constitute an image forming unit.

If the sheet is conveyed to the side-stitch tray F passed through the conveyance paths A and D and post-processed, such as alignment and stapling, by the side-stitch tray F, the sheet is conveyed by operation of a guide member 44 to either the conveyance path C, which leads the sheet to the shift tray 202, or a saddle-stitch/half-folding tray G that performs post-processing, such as half-folding (hereinafter, "saddle-stitch tray"). If the sheet is folded by the saddle-stitch tray G, the folded sheet is conveyed to a lower tray 203 passed through a conveyance path H. A switching claw 17 is arranged near the conveyance path D and the orientation of the switching claw 17 is maintained as shown in FIG. 1 by effect of a low-weighting spring (not shown). After the trailing edge of the sheet is passed through the switching claw 17 by a pair of conveyance rollers 7, a pair of conveyance rollers 9 is rotated reversely so that the sheet is conveyed in the reverse direction along a turn guide 8. The conveyance rollers 9 can be rotated together with any of a pair of conveyance rollers 10 and a pair of staple discharge rollers 11. The sheet is conveyed to a sheet accommodating unit E with its trailing edge ahead and stacked (pre-stacked) in the sheet accommodating unit E. Therefore, the sheet can be conveyed together with the next sheet overlapped with each other. If this operation is repeated, two or more sheets can be conveyed together in the overlapped manner. The reference numeral 304 is a pre-stack sensor that is used to set a reverse conveyance timing of the sheet to be pre-stacked.

The following units are arranged near the conveyance path A that is upstream of the conveyance paths B, C, and D and is connected to each of the conveyance paths B, C, and D, such as an entrance sensor 301 that detects receiving of the sheet from the image forming apparatus PR, a pair of entrance rollers 1, the punching unit 100, a punch waste hopper 101, a pair of conveyance rollers 2, the switching claws 15 and 16, in which these units are arranged in this order with the entrance sensor 301 being most-upstream. The orientations of the switching claws 15 and 16 are maintained as shown in FIG. 1 by effects of springs (not shown). The orientations of the switching claws 15 and 16 can be changed by turning solenoids (not shown) ON and a combination of the orientations determines to which conveyance path the sheet is to be conveyed, the conveyance path B, C, or D.

If the sheet is to be conveyed to the conveyance path B, the solenoids are OFF and therefore the orientations are maintained as shown in FIG. 1. The sheet is conveyed to the upper tray 201 passed through a pair of conveyance rollers 3 and a pair of upper discharge rollers 4. If the sheet is to be conveyed to the conveyance path C, the solenoids are turned ON and therefore the switching claw 15 swings upward and the switching claw 16 swings downward. The sheet is conveyed to the shift tray 202 passed through a pair of conveyance rollers 5 and a pair of shift discharge rollers 6 (6*a*, 6*b*). If the sheet is to be conveyed to the conveyance path D, the solenoid of the switching claw 16 is OFF and therefore the orientation is maintained as shown in FIG. 1, while the solenoid of the switching claw 15 is turned ON and therefore the switching claw 15 swings upward.

Various sheet processing can be performed by the sheet post-processing device, such as punching (the punching unit 100), sheet alignment+side stitch (a jogger fence 53 and a side-stitch stapler S1), sheet alignment+saddle stitch (a saddle-stitch upper jogger fence 250*a*, a saddle-stitch lower jogger fence 250*b*, and a saddle-stitch stapler S2), sheet sorting (the shift tray 202), and half folding (a folding plate 74 and a pair of folding rollers 81).

2. Shift Tray Unit

Figure 2:
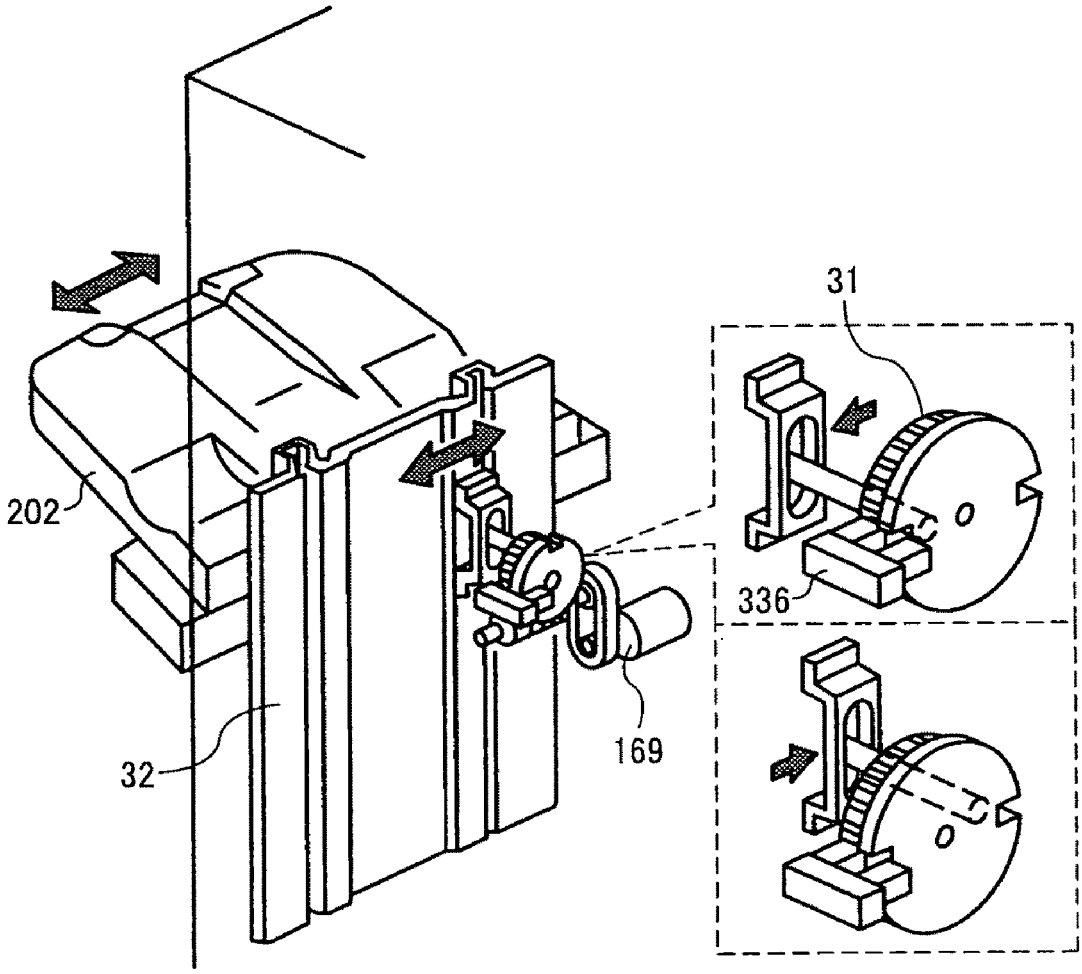
FIG. 2 is a perspective view of a shifting mechanism in the sheet post-processing device shown in FIG. 1.

As shown in FIG. 1, a shift-tray discharging unit that is arranged most-downstream of the sheet post-processing device PD includes the paired shift discharge rollers 6 (6*a*, 6*b*), a reverse roller 13, sheet-surface detecting sensors 330, the shift tray 202, a shifting mechanism that moves the shift tray 202 from side to side in a direction orthogonal to the sheet conveying direction, and a shift-tray moving-up/down mechanism that moves the shift tray 202 up and down. The details of the shifting mechanism are illustrated in FIG. 2.

The reference numeral 13 shown in FIG. 1 is a reverse roller. The reverse roller 13 is a sponge roller that, after the sheet is passed through the shift discharge rollers 6, comes into contact with the sheet so that the trailing edge of the sheet comes abut against an end fence 32 for alignment. The reverse roller 13 is rotated by rotary force of the shift discharge rollers 6. A tray upper-limit switch 333 is arranged near the reverse roller 13. When the shift tray 202 moves up and pushes the reverse roller 13 up, the tray upper-limit switch 333 is turned ON and thereby a tray moving-up/down motor 168 stops. This prevents the shift tray 202 from overrunning the upper limit. As shown in FIG. 1, there are arranged near the reverse roller 13 the sheet-surface detecting sensors 330 that work as a sheet-surface-position detecting unit that detects a position of the surface of the sheet or the sheet set stacked on the shift tray 202.

In the present embodiment, each of the stapled sheet-surface detecting sensor 330*a* and the unstapled sheet-surface detecting sensor 330*b* is ON when it is behind a shielding unit 30*b*. Therefore, when the shift tray 202 moves up and a contact member 30*a* of a sheet-surface detecting lever 30 swings up, the stapled sheet-surface detecting sensor 330*a* is turned OFF first, and when the contact member 30*a* further swings up, the unstapled sheet-surface detecting sensor 330*b* is then turned ON. When it is detected using the stapled sheet-surface detecting sensor 330*a* and the unstapled sheet-surface detecting sensor 330*b* that an amount of the stacked sheets increases to a predetermined height, the shift tray 202 moves a predetermined height down according to the driving of the tray moving-up/down motor 168. With this configuration, the sheet surface of the shift tray 202 is always positioned near the predetermined height.

Figure 3:
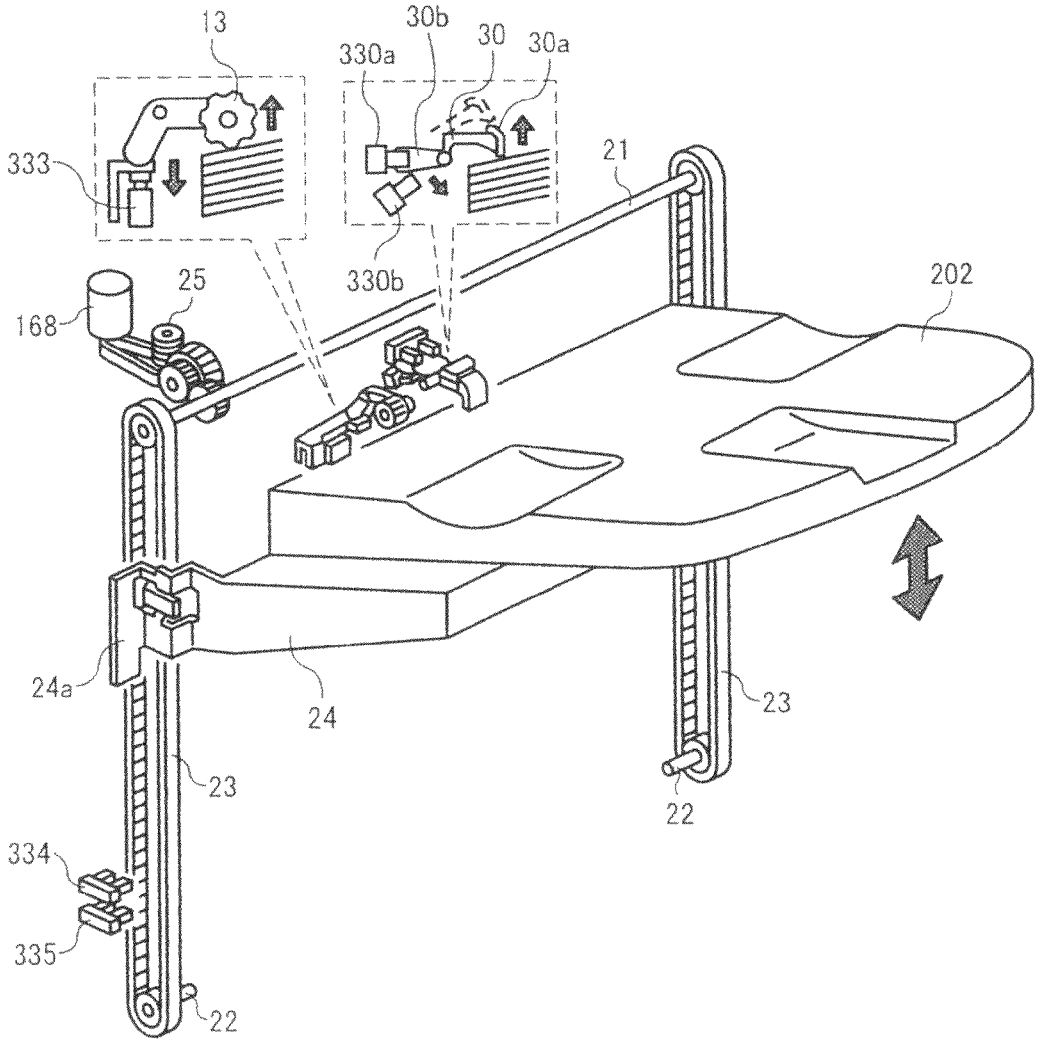
FIG. 3 is a perspective view of a moving-up/down mechanism that moves a shift tray in the sheet post-processing device shown in FIG. 1.

As shown in FIG. 3, a driving unit drives a driving shaft 21 to move the shift tray 202 up and down. Timing belts 23 are supported by the driving shaft 21 and a driven shaft 22 via timing pulleys. The timing belts 23 are fixed to a side plate 24 that supports the shift tray 202. With this configuration, the shift tray 202 and the relevant units are suspended so that they can move up and down.

The forward/reverse driving force generated by the tray moving-up/down motor 168 is transmitted via a worm gear 25 to the last one of a series of gears that is fixed to the driving shaft 21 so as to move the shift tray 202 up and down. The presence of the worm gear 25 is effective to maintain the shift tray 202 at a fixed position and prevent a sudden fall-down of the shift tray 202.

The side plate 24 of the shift tray 202 and a shielding plate 24*a* are formed as a unit. A full-status detecting sensor 334 that detects whether the shift tray 202 is full with stacked sheets and a lower-limit sensor 335 that detects the lower limit are arranged under the side plate 24 and the shielding plate 24*a*. The full-status detecting sensor 334 and the lower-limit sensor 335 are turned ON/OFF by the position of the shielding plate 24*a*. The full-status detecting sensor 334 and the lower-limit sensor 335 are photosensors. When the full-status detecting sensor 334 and the lower-limit sensor 335 are behind the shielding plate 24*a*, they are ON. The shift discharge rollers 6 are not shown in FIG. 3.

As shown in FIG. 2, the swinging mechanism of the shift tray 202 rotates a shift cam 31 using a shift motor 169 as a driving source. The shift cam 31 is attached with an uprising pin a predetermined distance away from the rotational axis of the shift cam 31. The pin is movably engaged with an elongated hole of the end fence 32. The end fence 32 guides the trailing edges of the sheets on the shift tray 202 and is engaged with the shift tray 202 in the direction orthogonal to the sheet discharging direction. The end fence 32 is moved in the direction orthogonal to the sheet discharging direction by rotation of the shift cam 31. The shift tray 202 moves together with the end fence 32. The shift tray 202 stops at two positions, i.e., a front position and a back position. The stop positions are detected by a shift sensor 336, and the movement in the direction orthogonal to the sheet discharging direction is controlled by ON/OFF of the shift motor 169.

Figure 4:
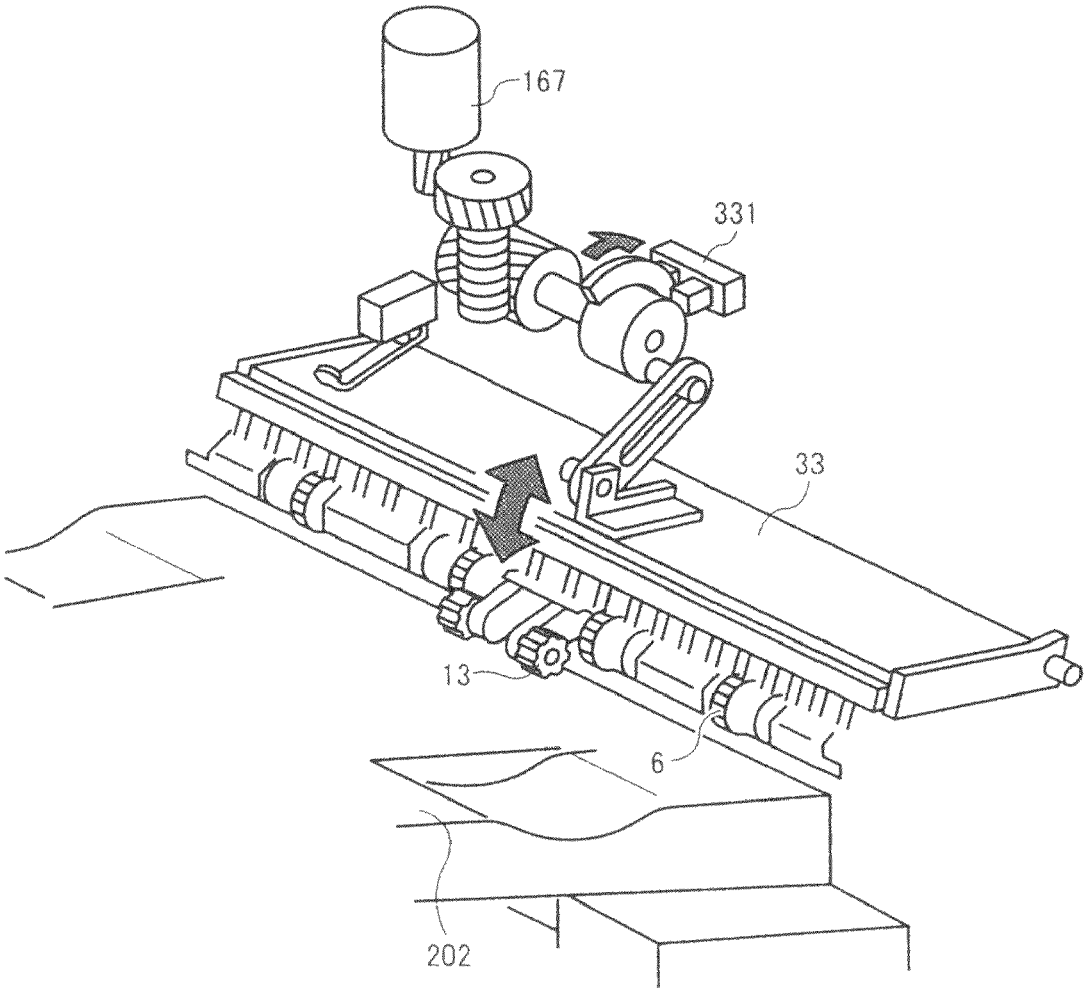
FIG. 4 is a perspective view of the configuration of a pair of shift discharge rollers and an open/close guide plate in the sheet post-processing device shown in FIG. 1.

The shift discharge rollers 6 are formed with the driving roller 6*a* and the driven roller 6*b*. As shown in FIGS. 1 and 4, the driven roller 6*b* is rotatably supported by a free end of an open/close guide plate 33 that can swing up and down with an upstream side in the sheet discharging direction being fixed. The driven roller 6*b* comes into contact with the driving roller 6*a* by its own weight or a bias force. The sheet is discharged, nipped between the rollers. If a stapled sheet set is to be discharged, the open/close guide plate 33 swings up and swings down a predetermined time after. The timing to swing the open/close guide plate 33 down is determined depending on a detection signal of a shift discharging-sheet sensor 303. The stop position is determined depending on a detection signal of a discharge guide-plate open/close sensor 331. The open/close guide plate 33 is driven by a discharge guide-plate open/close motor 167.

3. Side-Stitch Tray Unit

The configuration of the side stitch tray F that performs the stapling process is described with reference to FIGS. 5, 6, 12, and 13.

3.1 General Configuration of Side Stitch Tray

After the sheets are conveyed to the side stitch tray F by the staple discharge rollers 11, the sheets are sequentially stacked on the side stitch tray F. In this case, the sheets are aligned one by one using a reverse roller 12 in the up-and-down direction (sheet conveying direction), while the sheets are aligned using the jogger fences 53 in the side-to-side direction (direction orthogonal to the sheet conveying direction, this referred to as "sheet width direction"). The side-stitch stapler S1 is driven according to a staple signal received from a control circuit 350 (see FIG. 33) so that the stapling process is performed during an interval between jobs ("job" means, hereinafter, a series of processes for a single sheet set), i.e., in a period between the last sheet of a first job and the top sheet of a second job. The stapled sheet set is immediately conveyed to the shift discharge rollers 6 by an ejection belt 52 equipped with a protruded ejection claw 52*a* and then discharged onto the shift tray 202 that is arranged at a receiving position.

3.2 Sheet Ejection Mechanism

Figure 12:
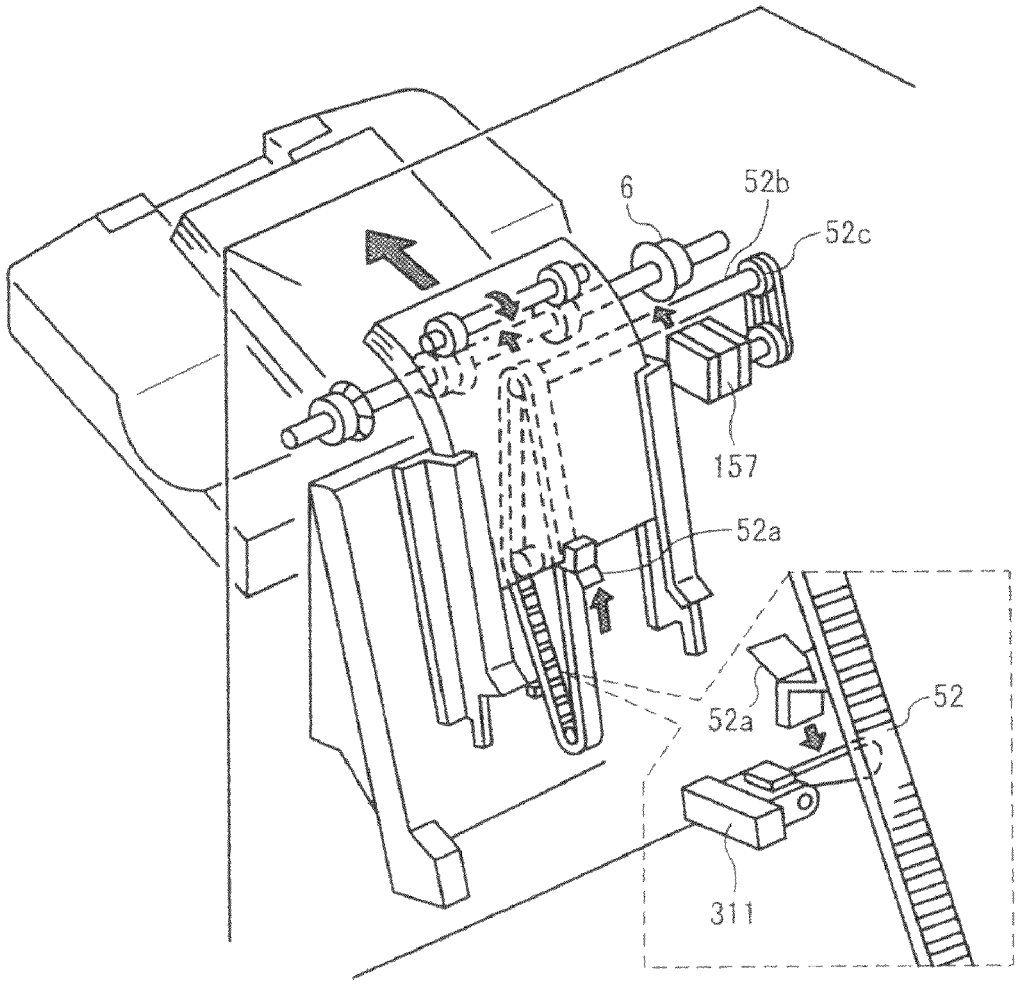
FIG. 12 is a perspective view of a driving mechanism that drives an ejection belt and an ejection claw that pushes the sheet set up.

As shown in FIG. 12, the home position of the ejection claw 52*a* is detected by an ejection-belt HP sensor 311. The ejection-belt HP sensor 311 is turned ON/OFF by the position of the ejection claw 52*a* provided to the ejection belt 52. The ejection claw 52*a* and an ejection claw 52*a*' are arranged on an outer circumference of the ejection belt 52 opposite to each other. The ejection claws 52*a* and 52*a*' alternately convey the sheet set from the side stitch tray F. If required, the ejection belt 52 can rotate reversely with the sheet set being on the side stitch tray F so that the edges of the sheet set in the sheet conveying direction are aligned using the ejection claw 52*a* that is on standby to convey the sheet set and the back surface of the ejection claw 52*a*' that is at the opposite position to the ejection claw 52*a*. Therefore, the ejection claw 52*a* can work as an alignment means that aligns the sheet set in the sheet conveying direction.

Figure 5:
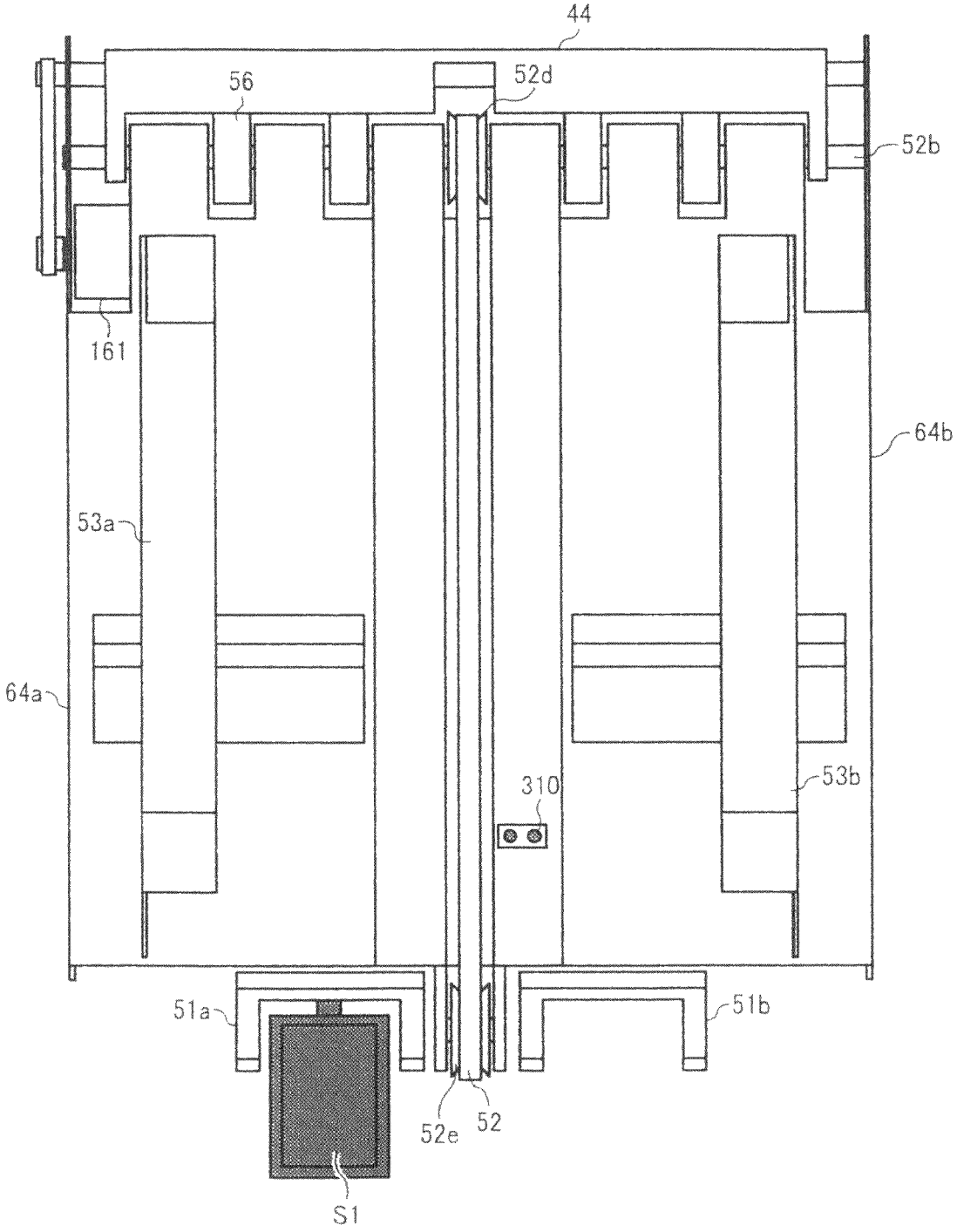
FIG. 5 is a plane view of the configuration of a side stitch tray that performs a stapling process.

As shown in FIG. 5, the ejection belt 52 is arranged at the center in the sheet width direction, is supported by a driving pulley 52*d* and a driven pulley 52*e*, and is driven by an ejection motor 157 via a driving shaft 52*b* and a pulley 52*c* as shown in FIG. 12. A plurality of ejection rollers 56 are arranged symmetrically with respect to the ejection belt 52. The ejection rollers 56 are rotatably provided to the driving shaft 52*b* and work as driven rollers. The reference numeral 64*a* is a front-side plate; the reference numeral 64*b* is a back-side plate; the reference numeral 51*a* is a front-side trailing-edge fence; the reference numeral 51*b* is a back-side trailing-edge fence (the reference numeral 51 shown in FIG. 1 indicates both the reference numerals 51*a* and 51*b*); the reference numeral 53*a* is the front-side jogger fence; and the reference numeral 53*b* is the back-side jogger fence.

3.3 Processing Mechanism

Figure 6:
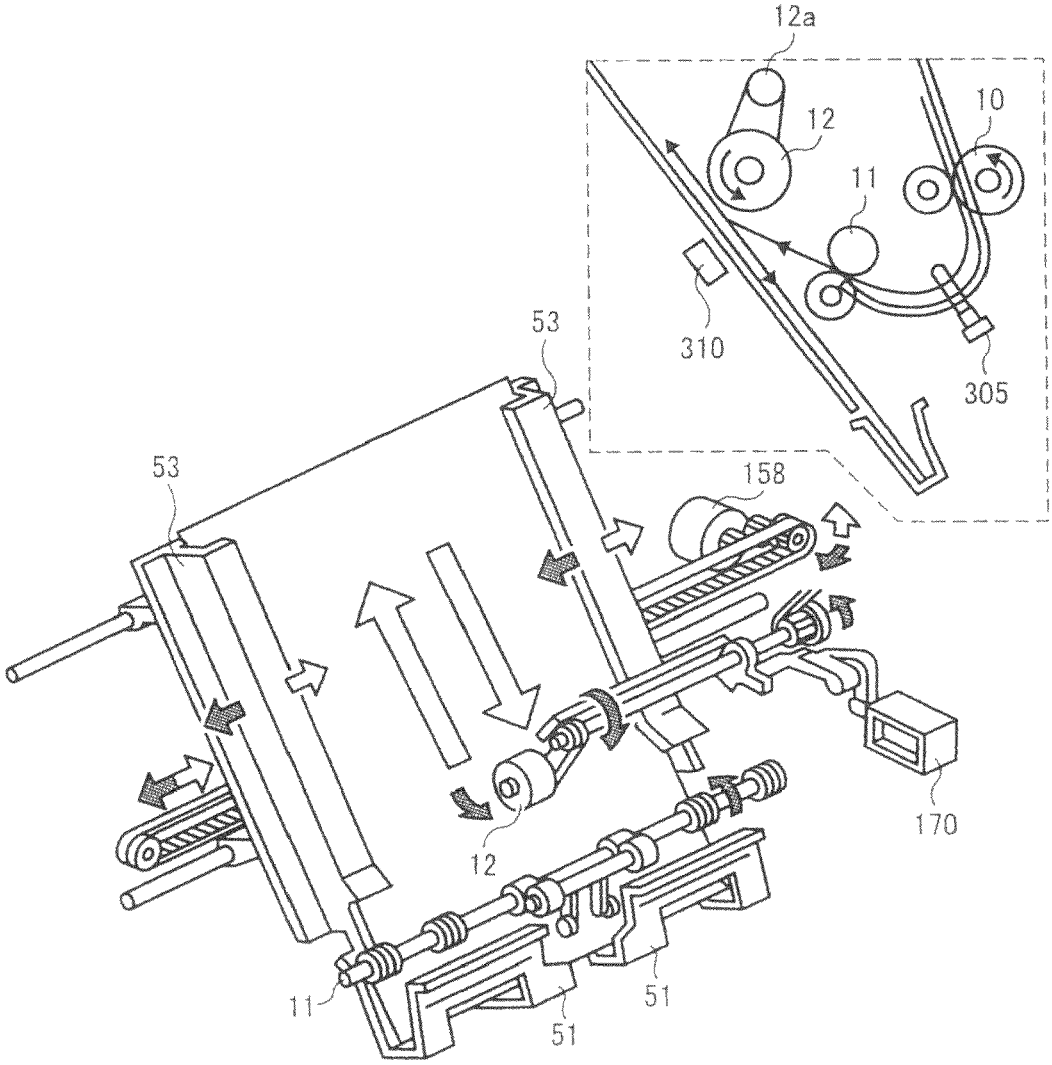
FIG. 6 is a perspective view of the configuration of the side stitch tray that performs the stapling process.

As shown in FIG. 6, the reverse roller 12 is given pendulum motion by a tapping SOL 170 and swings about a fulcrum 12*a*. The swing operates on the sheet coming onto the side stitch tray F, intermittently so that the trailing edge of the sheet comes abut against the trailing-edge fences 51. The reverse roller 12 rotates in the counterclockwise direction. The jogger fences 53 are, as shown in FIG. 5, a pair of the front-side fence and the back-side fence and moved in the sheet width direction by a jogger motor 158 that can rotate both forward and rearward via a timing belt.

Figure 13:
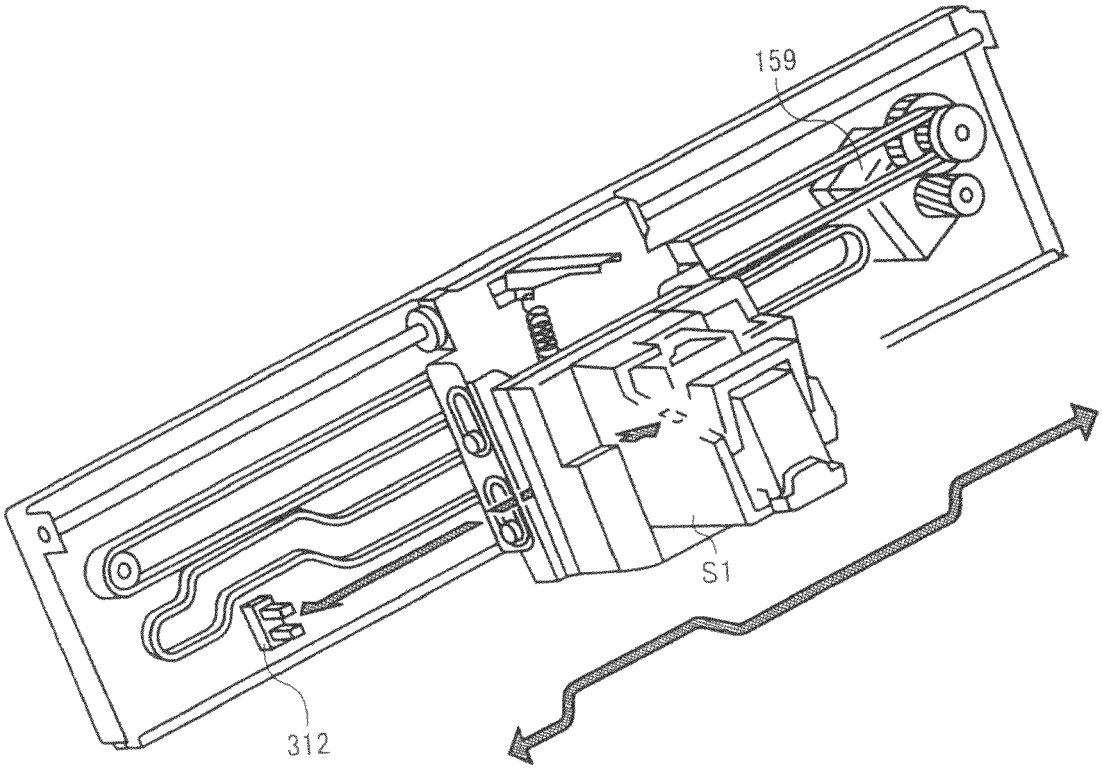
FIG. 13 is a perspective view of the configuration of a side-stitch stapler.

The side-stitch stapler S1, as shown in FIG. 13, is driven by a stapler moving motor 159 that can rotate both forward and rearward via a timing belt so that the side-stitch stapler S1 moves in the sheet width direction to staple a predetermined edge position of the sheet set. A stapler moving HP sensor 312 that detects the home position of the side-stitch stapler S1 is arranged at an end of the moving range. The moving to the stapling position in the sheet width direction is controlled by a distance of the side-stitch stapler S1 moving away from the home position.

Figure 14:
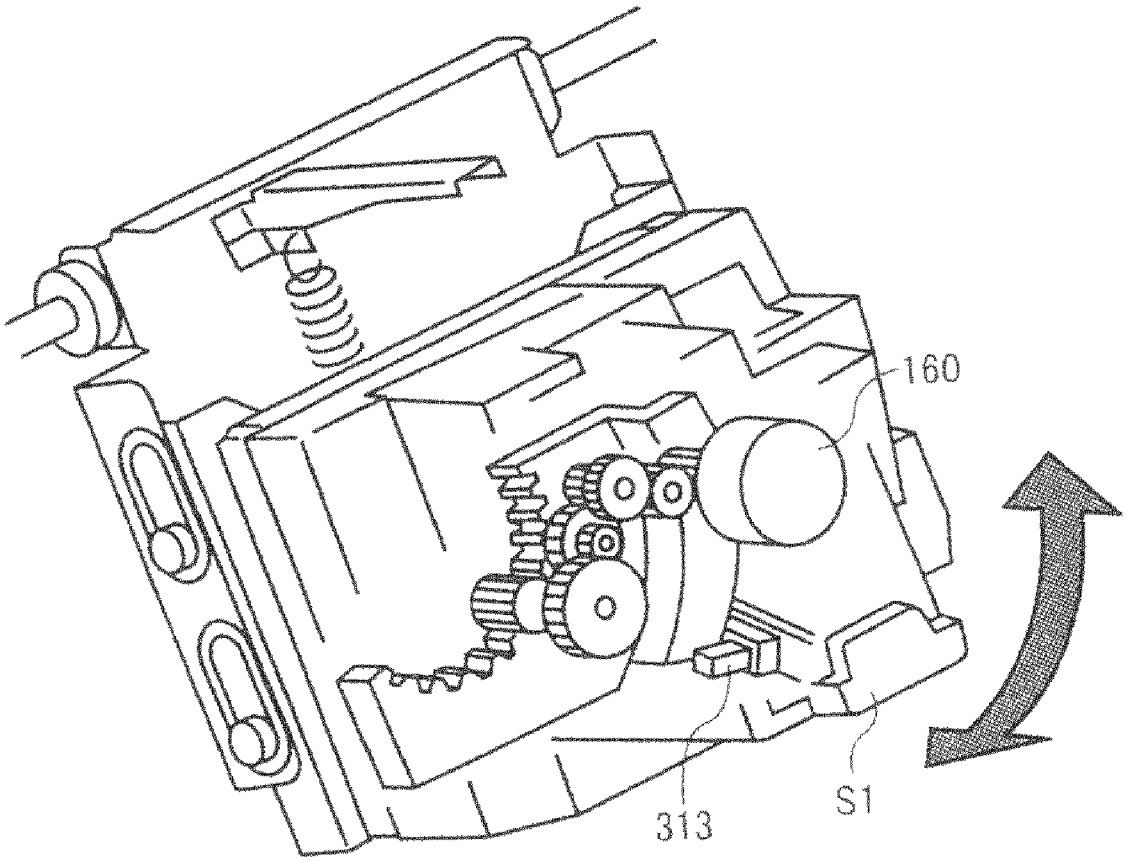
FIG. 14 is a perspective view of a slant stapling mechanism of the side stitch stapler.

FIG. 14 is a perspective view of a slant stapling mechanism of the side-stitch stapler S1. The side-stitch stapler S1 can change the angle of staples, i.e., can fix staples both parallel and unparalleled to the sheet side. Moreover, only a part of the side-stitch stapler S1 that works as a stapling mechanism rotates a predetermined angle at the home position, which facilitates staple replacement. When the side-stitch stapler S1 rotates and a staple replacement position sensor detects that the angle of the rotation increases to a predetermined value or the side-stitch stapler S1 rotates to the staple replacement position, a slant motor 160 stops. When the slant stapling is completed or the staple replacement is completed, the side-stitch stapler S1 rotates back to the previous position for the next stapling. The reference numeral 310 shown in FIGS. 1 and 5 is a sheet presence/absence sensor that detects presence/absence of sheets on the side stitch tray F.

3.4 Sheet-Set Trailing-Edge Suppressing Mechanism

A mechanism that suppresses the swollen trailing edge of the sheet set that is stacked on the side stitch tray F is described with reference to FIGS. 7 to 11.

Figure 7:
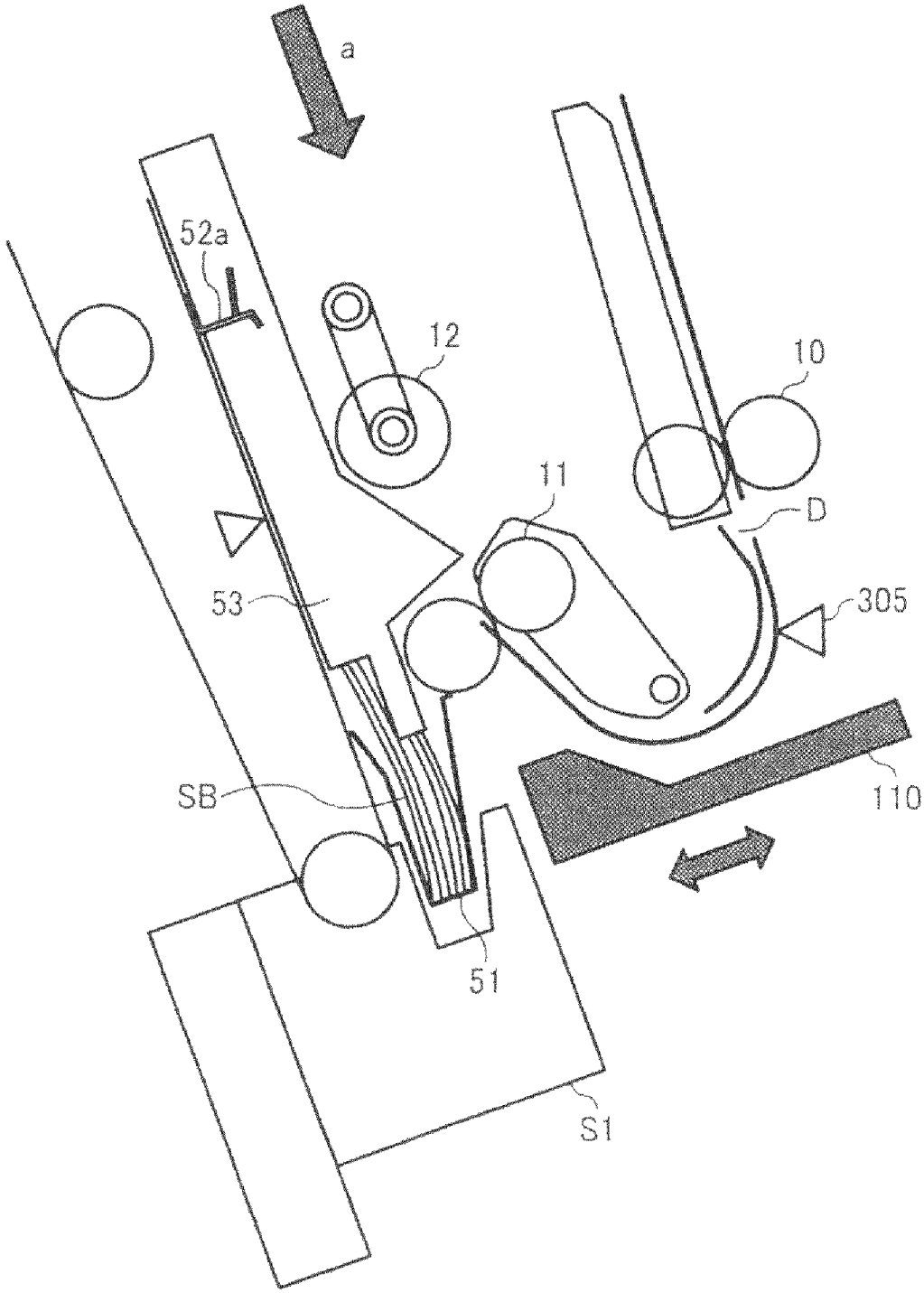
FIG. 7 is a schematic view of a mechanism that suppresses the swollen trailing edge of the sheet set that is stacked on the side stitch tray.

The sheets on the side stitch tray F are aligned using the reverse roller 12 one by one in the up-and-down direction (sheet conveying direction) as mentioned above. If the trailing edges of the sheets stacked on the side stitch tray F have curl or the sheets are easy to bend, the trailing edges are tend to bend by their own weights and therefore be swollen. As the number of the stacked sheets increases, a gap of the trailing-edge fences to receive the coming sheet decreases and therefore the performance of the alignment in the up-and-down direction decreases. To solve the problem, the trailing-edge suppressing mechanism decreases the thickness of the trailing edges of the sheets so that the coming sheet can smoothly enter the trailing-edge fences 51. FIG. 7 is a schematic diagram of the trailing-edge suppressing mechanism, viewed from the front side. Trailing-edge suppressing levers 110 (110*a*, 110*b*, and 110*c*) are arranged in a lower part of the trailing-edge fences 51 so as to suppress the trailing edges of the sheets accommodated in the trailing-edge fences 51. The trailing-edge suppressing levers 110 move back and forth in the direction substantially orthogonal to the side stitch tray F.

Figure 8:
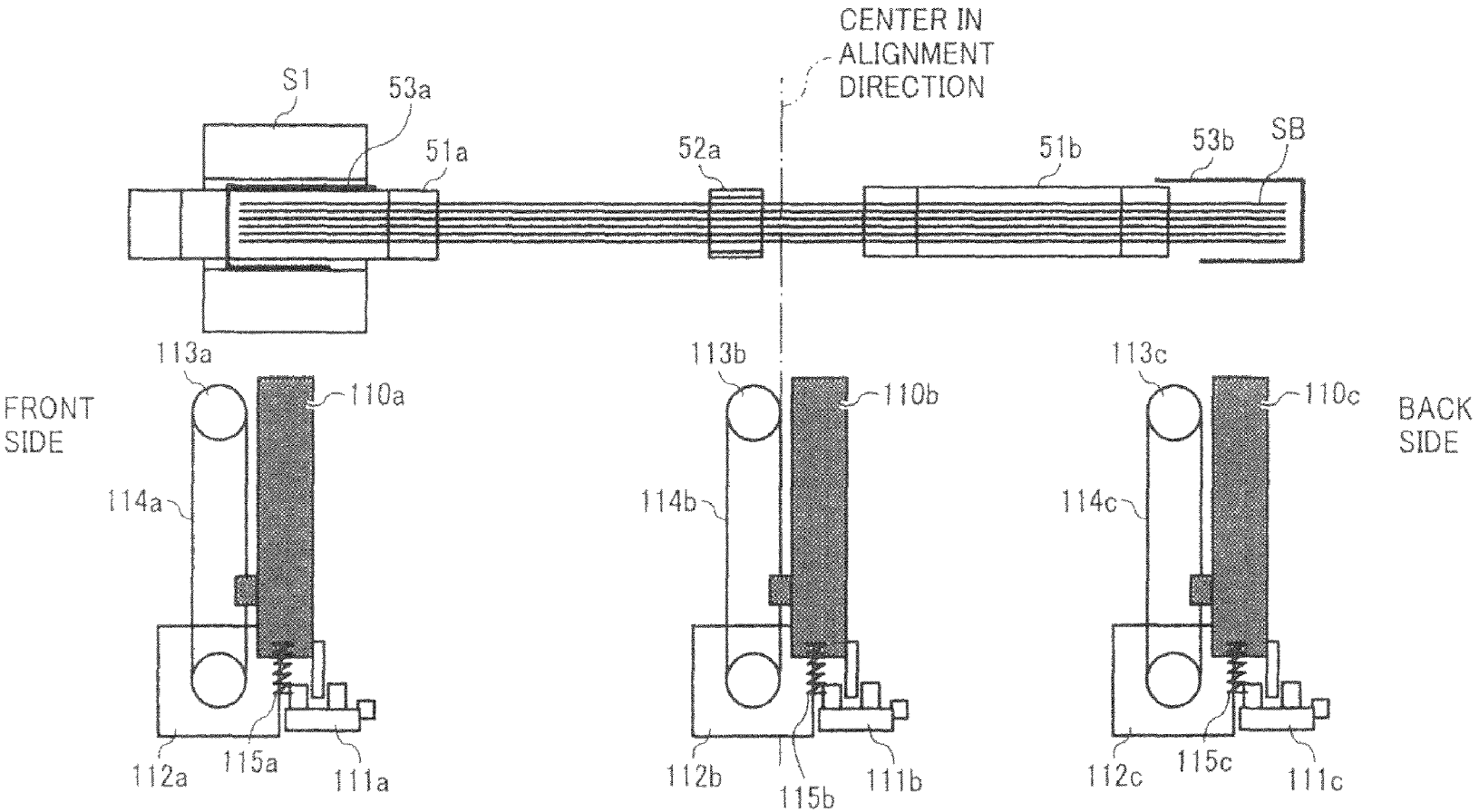
FIG. 8 is a perspective view of the mechanism shown in FIG. 7 viewed from the direction indicated an arrow a shown in FIG. 7.

As shown in FIG. 8, the trailing-edge suppressing levers 110*a*, 110*b*, and 110*c* that suppress the trailing edges of the sheets stacked on the side stitch tray F are arranged at the front side, the center, and the back side, respectively. The mechanism of the front-side trailing-edge suppressing lever 110*a* is described below. The trailing-edge suppressing lever 110*a* is fixed to a timing belt 114*a*. Because the timing belt 114*a* is connected to a trailing-edge suppressing lever motor 112*a* and a pulley 113*a*, the trailing-edge suppressing lever 110*a* moves associated with rotation of the trailing-edge suppressing lever motor 112*a*. When a convex shielding member that is provided to the trailing-edge suppressing lever 110*a* in a protruded manner shields a home sensor 111*a*, the home position of the trailing-edge suppressing lever 110*a* is detected. The home position of the trailing-edge suppressing lever 110*a* is set to a position in the moving range over which the side-stitch stapler S1 moves in the direction indicated by the arrow shown in FIG. 13 (moves in the sheet width direction to a position to staple the edge of the sheet) so that the home position cannot interfere with the side-stitch stapler S1. The direction in which the trailing-edge suppressing lever 110*a* suppresses the sheet trailing edge, i.e., the moving distance in the direction indicated by an arrow shown in FIG. 12 is determined by the number of input pulses to the trailing-edge suppressing lever motor 112*a* so that the end of the trailing-edge suppressing lever 110*a* comes into contact with the sheet set and moves to the position to suppress the swollen trailing edge of the sheet set. A change in the thickness of the stacked sheet set is absorbed by stretch of a spring 115*a*. The operations of the trailing-edge suppressing levers 110*b* and 110*c* are the same as the operation of the trailing-edge suppressing lever 110*a*. Therefore, the corresponding parts relevant to the trailing-edge suppressing levers 110*b* and 110*c* are denoted with the same reference numerals attached with "b" and "c" instead of "a" and the same descriptions are not repeated.

Figure 9:
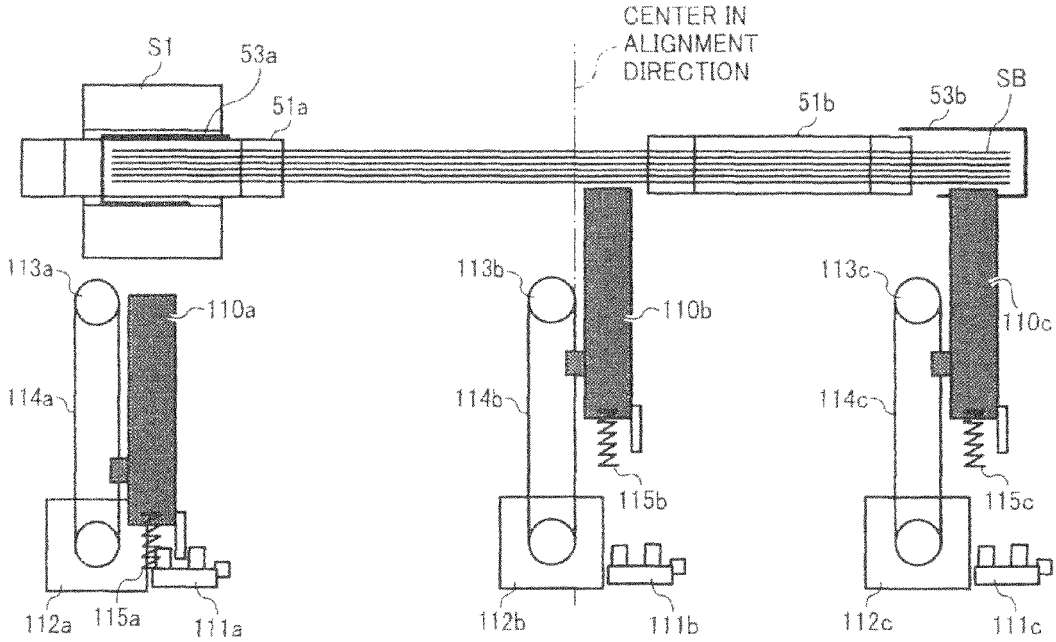
FIG. 9 is a schematic diagram that explains a relation between trailing-edge suppressing levers and stapler waiting positions in a front-side staple mode.
Figure 10:
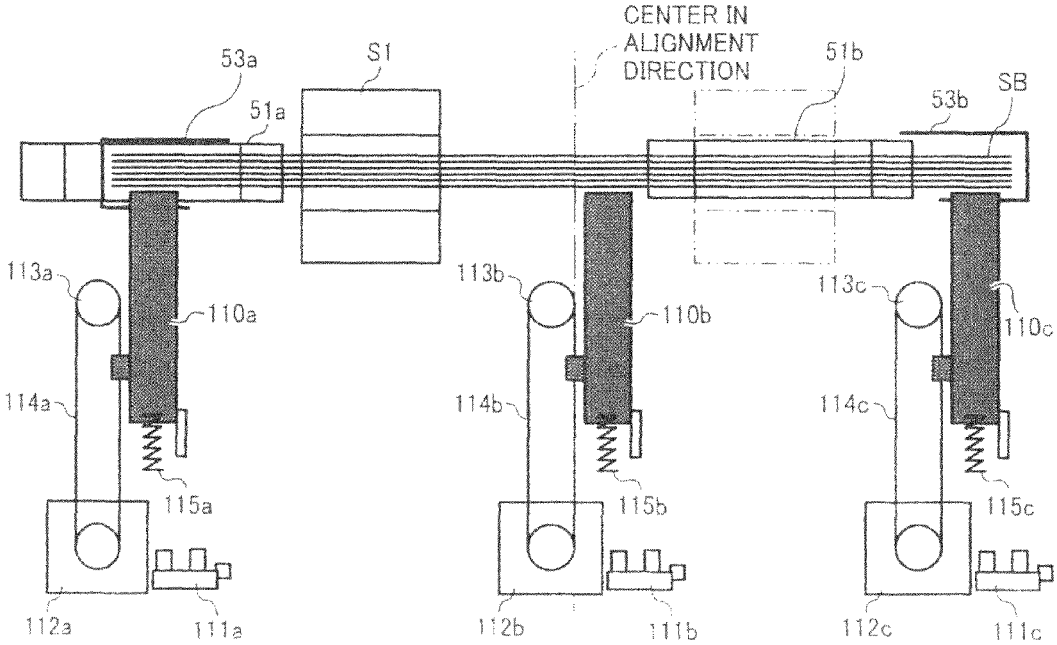
FIG. 10 is a schematic diagram that explains a relation between the trailing-edge suppressing levers and the stapler waiting positions in a two-position staple mode.
Figure 11:
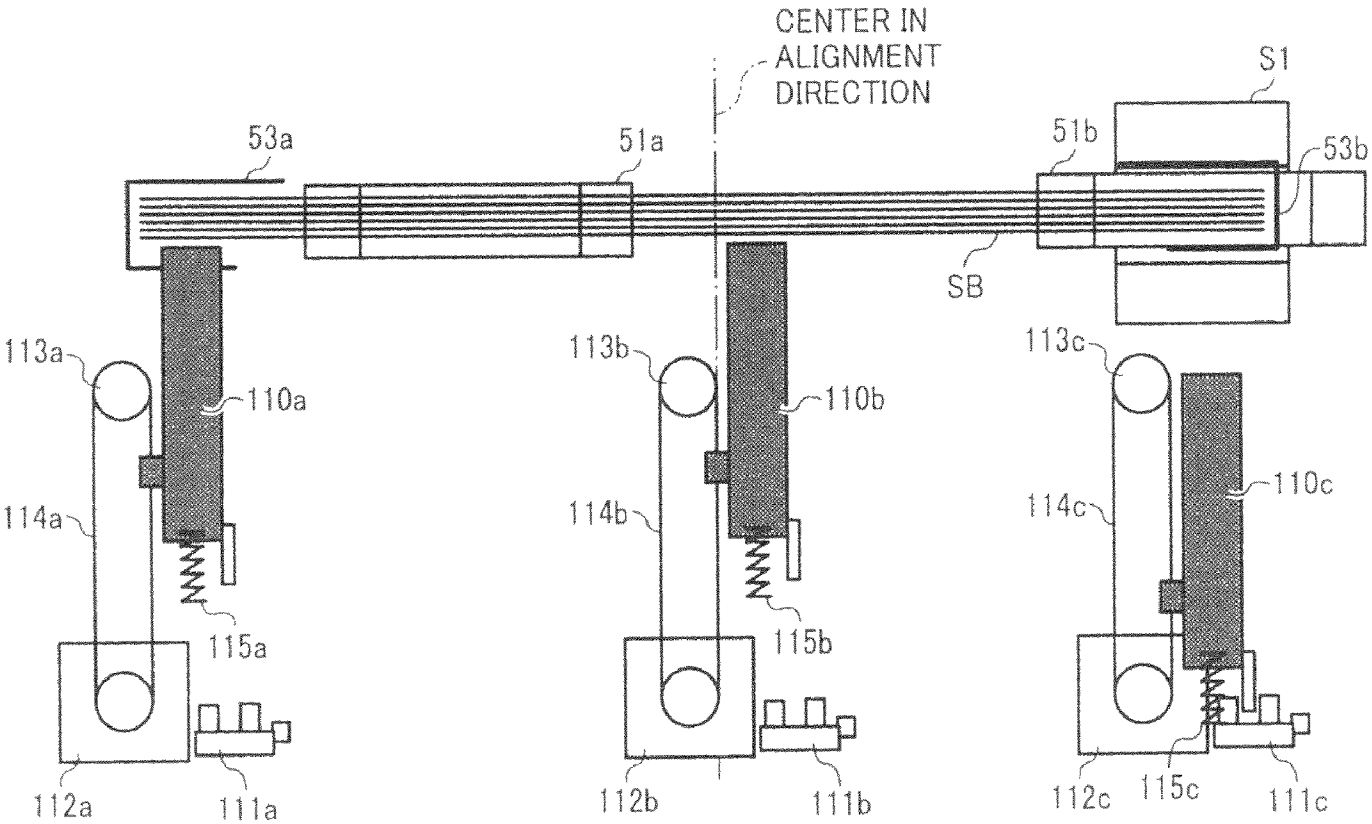
FIG. 11 is a schematic diagram that explains a relation between the trailing-edge suppressing levers and the stapler waiting positions in a back-side staple mode.

The relation between the trailing-edge suppressing levers 110*a*, 110*b*, and 110*c* and the side-stitch stapler S1 in various staple modes are described with reference to FIGS. 9 to 11. The positions of the side-stitch stapler S1 shown in FIGS. 9, 10, and 11 are the waiting positions in a front-side staple mode, a two-position staple mode, and a back-side staple mode, respectively. When the stapler S1 is in the waiting positions, the side-stitch stapler S1 does not interfere with operation of any of the trailing-edge suppressing levers 110*a*, 110*b*, and 110*c*. The trailing-edge suppressing levers 110*b* and 110*c* operate in the front-side staple mode shown in FIG. 9; the trailing-edge suppressing levers 110*a*, 110*b*, and 110*c* operate in the two-position staple mode shown in FIG. 10; and the trailing-edge suppressing levers 110*a* and 110*b* operate in the back-side staple mode shown in FIG. 11. The operation positions of the trailing-edge suppressing levers in the various modes are shown in FIGS. 9 to 11. The operation timing of the trailing-edge suppressing levers 110*a*, 110*b*, and 110*c* is set during a period between when the sheet is stacked onto the trailing-edge fences 51 and aligned by the jogger fences 53 in the sheet width direction and when the next sheet is aligned by the reverse roller 12.

4. Sheet-Set Deflecting Mechanism

Figure 15:
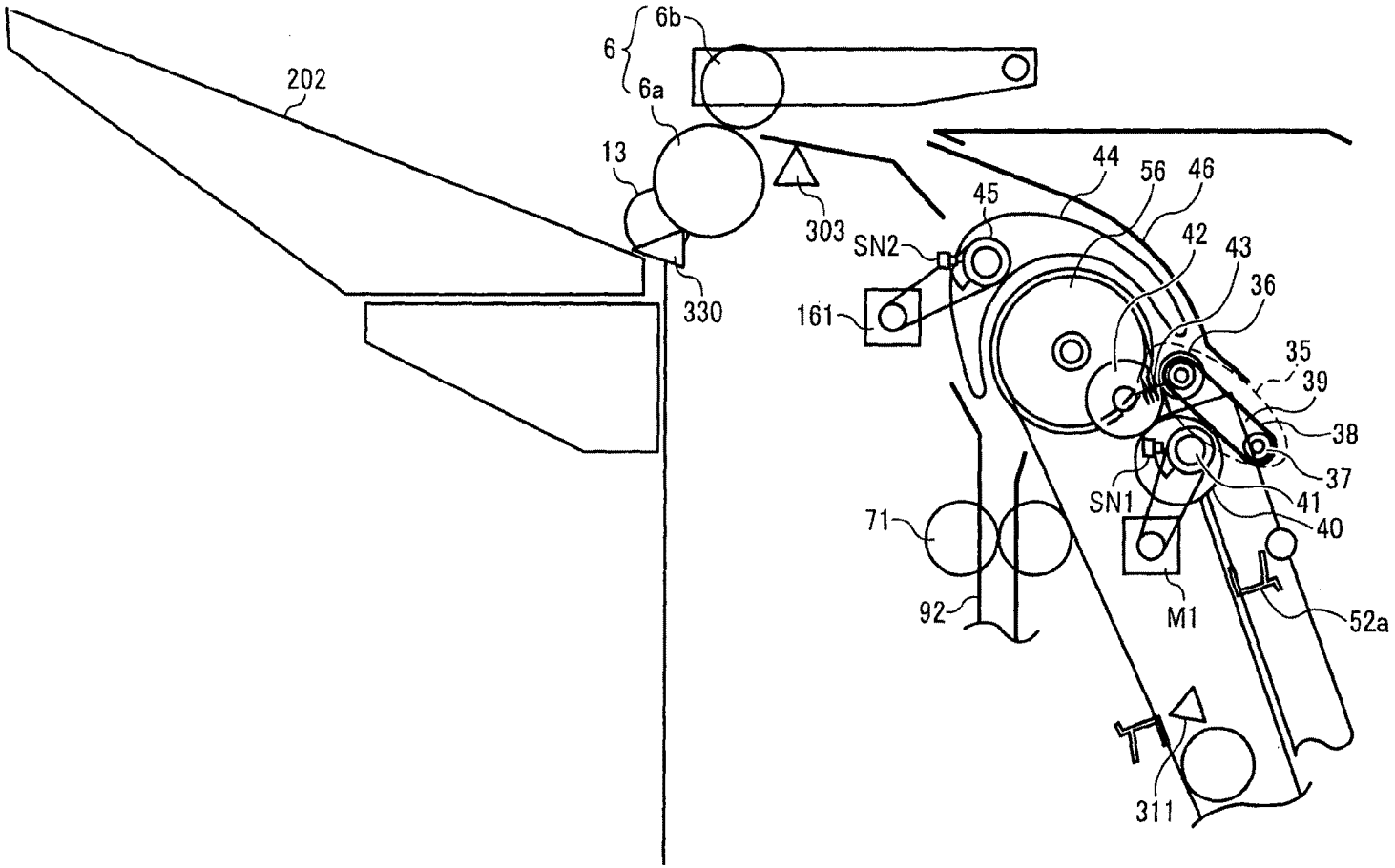
FIG. 15 is a schematic view of a sheet-set deflecting mechanism.

FIG. 15 is a schematic diagram of relevant parts of a sheet-set deflecting mechanism.

Figure 16A:
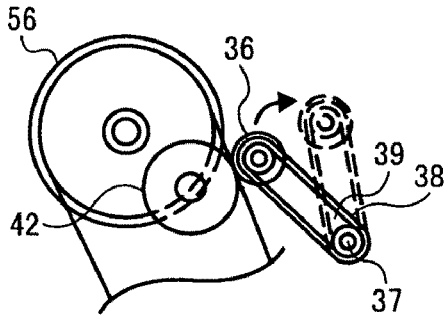
FIGS. 16A and 16B are schematic diagrams that explain exemplary sheet-set conveying mechanisms in the sheet-set deflecting mechanism.
Figure 16B:
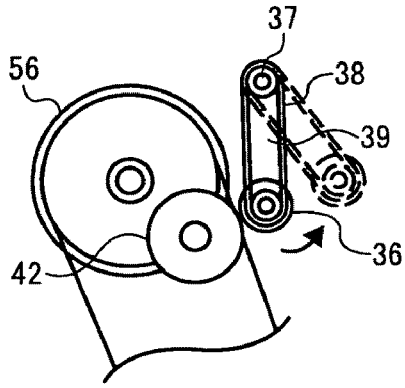

As shown in FIGS. 1 and 15, the conveyance path from the side stitch tray F to the saddle stitch tray G, the conveyance path from the side stitch tray F to the shift tray 202, and the conveyance unit that conveys the sheet set are formed with a conveying mechanism 35 that gives the sheet set a conveyance force; the ejection roller 56 that turns the sheet set; and the guide member 44 that guides the sheet set along a turning conveyance path 57. The details of those units are described below. As shown in FIG. 15, a roller 36 of the conveying mechanism is designed to receive a driving force from a driving shaft 37 via a timing belt 38. The roller 36 is connected to the driving shaft 37 via an arm 39 in such a manner that the roller 36 can swing about the driving shaft 37 as the fulcrum. The roller 36 of the conveying mechanism 35 is swung by rotation of a cam 40. The cam 40 is rotated about a rotating shaft 41 by a driving force received from a motor M1. The home position of the cam 40 that rotates the conveying mechanism 35 is detected by a sensor SN1. An additional sensor can be added to the system shown in FIG. 15 to adjust a rotation angle away from the home position. Alternatively, the motor M1 is pulse-controlled to adjust the rotation angle. The conveying mechanism 35 can take both a first configuration shown in FIG. 16A and a second configuration shown in FIG. 16B. Which configuration is to be taken is decided just by the arrangement of the other mechanisms and there is no priority between them.

Figure 17:
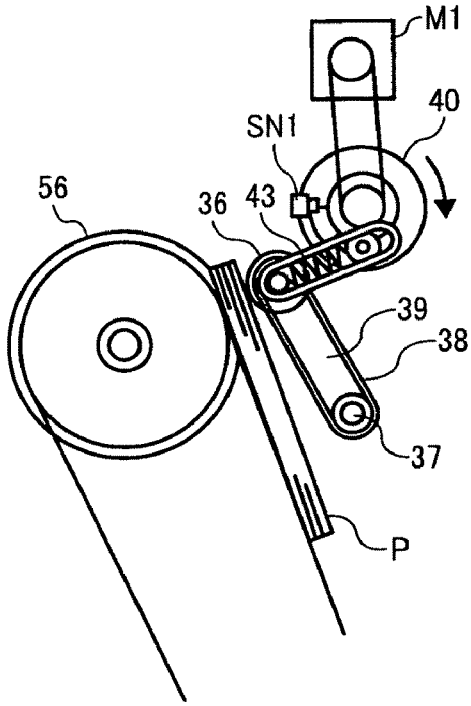
FIG. 17 is a schematic diagram that explains another exemplary sheet-set conveying mechanism in the sheet-set deflecting mechanism.
Figure 18A:
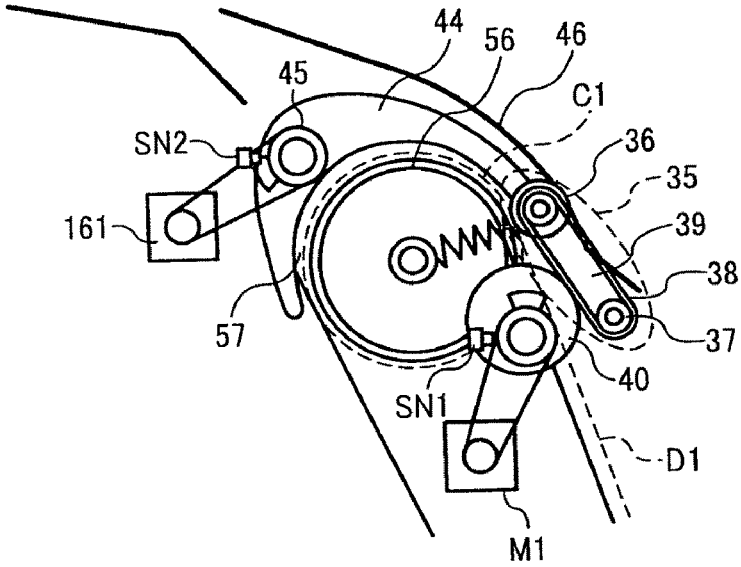
FIGS. 18A and 18B are schematic diagrams that explain operation of the sheet-set deflecting mechanism that can convey the sheet set in both a deflected direction and a non-deflected direction to the shift tray.

In the conveying mechanism 35, a driven roller 42 is arranged opposite to the roller 36. The driven roller 42 and the roller 36 nip the sheet set together and press the sheet set by a spring force of an elastic member 43, thereby giving the sheet set the conveyance force. Because as the thickness of a sheet set P increases, the required conveyance force increases, i.e. the required pressing force increases, it is allowable to move the roller 36 of the conveying mechanism 35 close to the driven roller 42 by rotation of the cam 40 via the elastic member 43 as shown in FIG. 17 so that the pressing force is adjusted by the angle of the cam 40. The ejection roller 56 can be used as the roller opposite to the roller 36 of the conveying mechanism 35 instead of the driven roller 42 as shown in FIG. 18A. If so, it is preferable to set the nip position between the roller 36 and the ejection roller 56 near a tangent point at which a sheet-set conveyance trajectory D1 is tangent to a concentric circle C1 of the ejection roller 56.

Figure 18B:
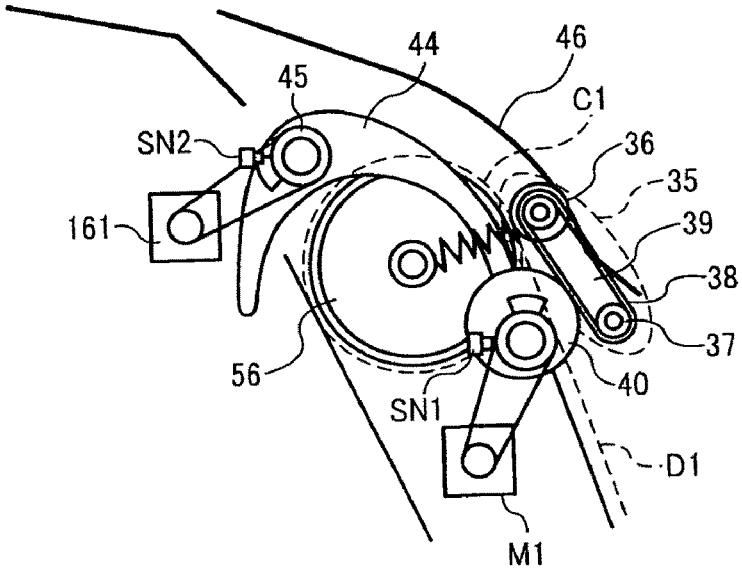

The turning conveyance path 57, through which the sheet set is conveyed from the side stitch tray F to the saddle stitch tray G, is formed with the ejection roller 56 and the guide member 44 that is opposite to the ejection roller 56. The guide member 44 is swung about a fulcrum 45 by a driving force received from a sheet-set turning-point driving motor 161. The home position of the guide member 44 is detected by a sensor SN2. To make a conveyance path through which the sheet set is conveyed from the side stitch tray F to the stacking unit, i.e., the shift tray 202, the guide member 44 swings about the fulcrum 45 in the clockwise direction as shown in FIG. 18B. The created space between the guide member 44 and a guide plate 46 is used as the conveyance path.

FIGS. 19 to 22 are schematic diagrams that explain basic operation of a sheet-set changing mechanism using the conveying mechanism 35, the guide member 44, and the ejection roller 56.

Figure 19:
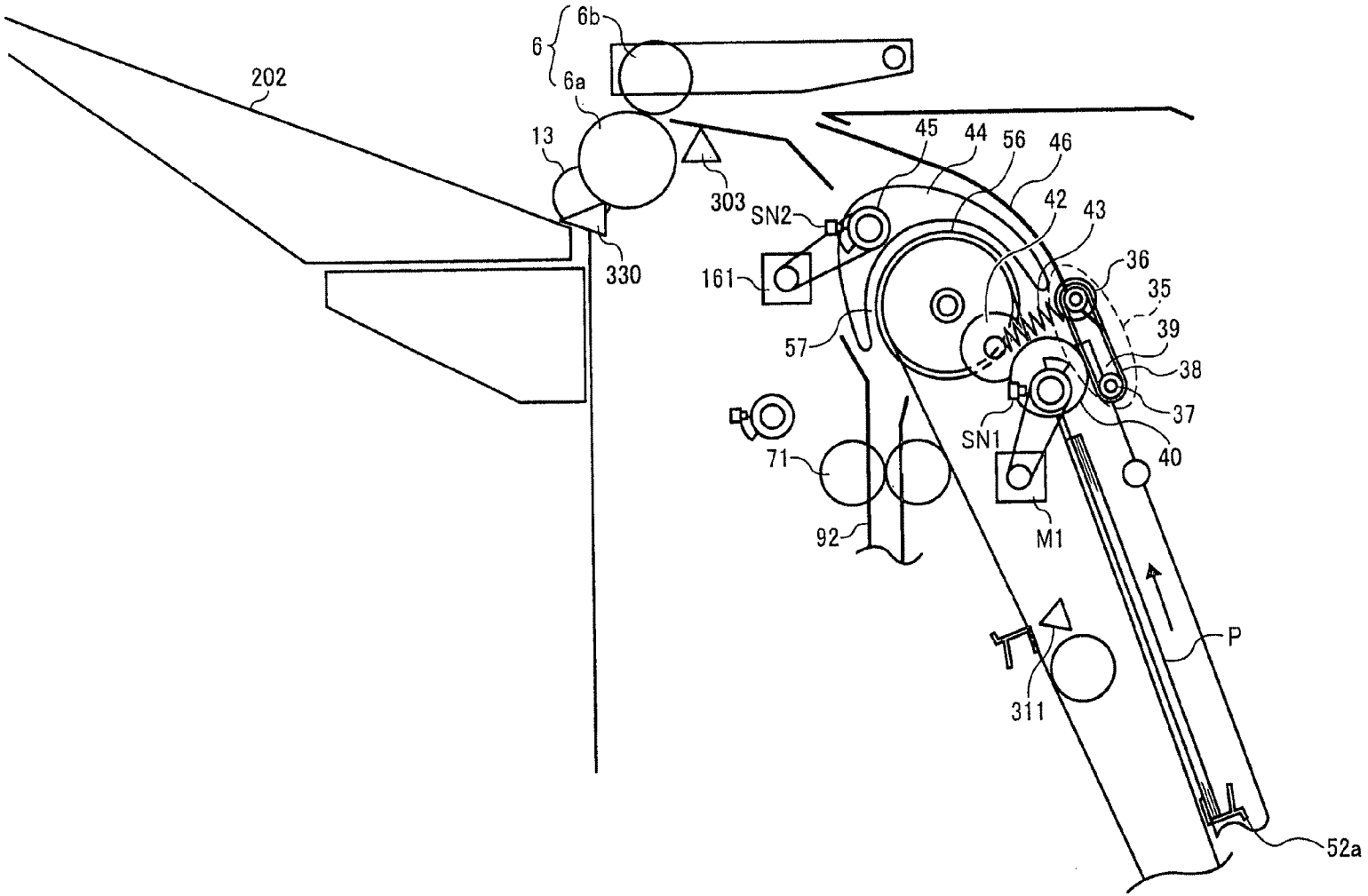
FIG. 19 is a schematic diagram that explains a situation when an ejection claw pushes up the sheet set that has been aligned by a side-stitch unit.

To convey the sheet set P from the side stitch tray F to the saddle stitch tray G, the trailing edge of the sheet set after aligned by the side stitch tray F is pushed up by the ejection claw 52*a* as shown in FIG. 19, and the sheet set is conveyed, nipped between the roller 36 of the conveying mechanism 35 and the driven roller 42 opposite to the roller 36. The roller 36 of the conveying mechanism 35 is on standby in such a manner the roller 36 cannot hit the edge of the sheet set P.

Figure 20A:
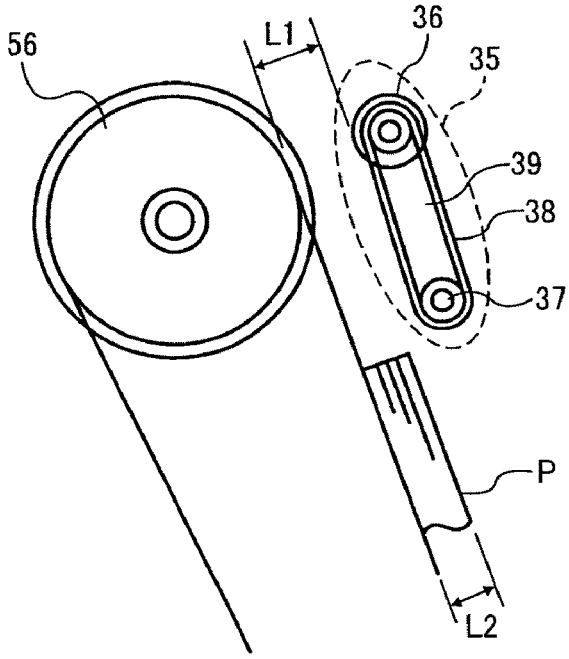
FIGS. 20A and 20B are schematic diagrams that explain a mechanism that prevents a jam caused by passage of the sheet set.
Figure 20B:
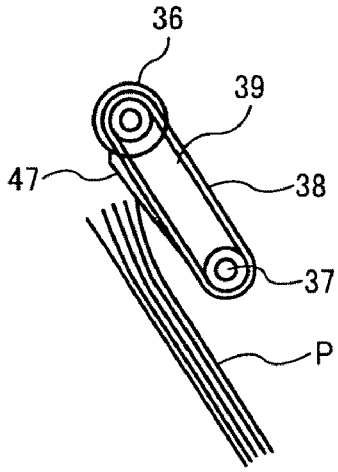

As shown in FIGS. 20A and 20B, a distance L1 between a surface of the side stitch tray F on which the sheet set is stacked for alignment, i.e., a surface along which the sheet set is guided when the sheet set is pushed up by the ejection claw 52*a* and the roller 36 is set wider than a maximum thickness of the sheet set that is conveyed from the side stitch tray F to the saddle stitch tray G so that the edge of the sheet set cannot hit the roller 36. Because the thickness of the sheet set is variable depending on the number of sheets or a type of sheets (type of paper) that are aligned by the side stitch tray F, the closest position of the roller 36 enough to avoid a hit against the edge of the sheet set P is variable. If a retraction position is set appropriately depending on information about the number of the sheets and the type of the sheets (type of paper), it is possible to set a time required to move from the retraction position to the position to give the conveyance force to its shortest. This will improve the productivity. The information about the number of the sheets and the type of the sheets (type of paper) can be received from the image forming apparatus PR as job information or from a sensor inside the sheet post-processing device PD. However, if the sheet set P after aligned by the side stitch tray F has too large curl, the sheet edge may come into contact with the roller 36 when the sheet set P is pushed up by the ejection claw 52*a*; therefore, it is necessary to arrange a guide 47 immediately upstream of the roller 36 so as to decrease an angle that the sheet edge comes into contact with the roller. The same effect can be obtained regardless of the guide 47 being a fixed member or an elastic member.

Figure 21:
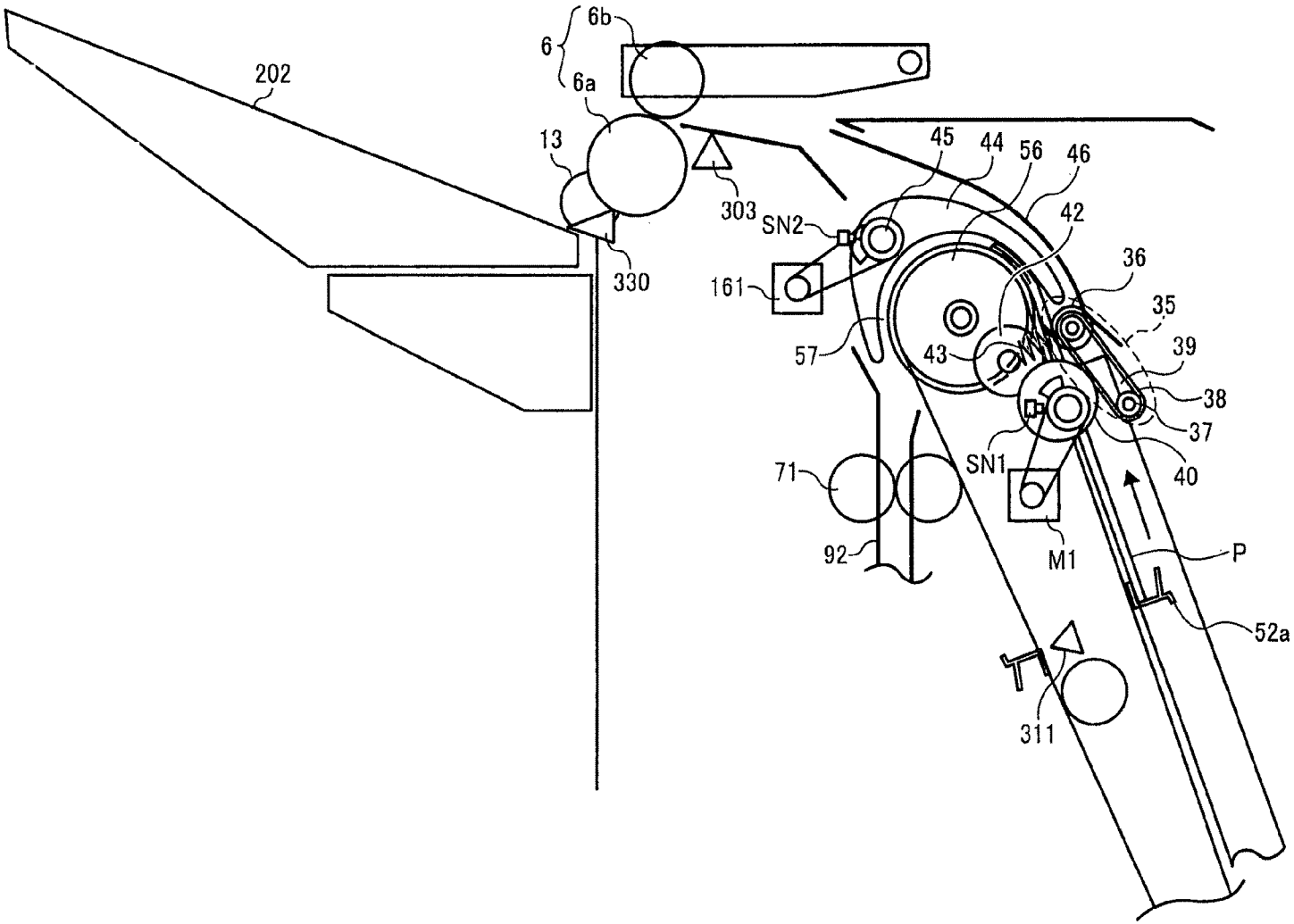
FIG. 21 is a schematic diagram that explains a situation in a sheet-set deflecting process where, after the sheet-set leading edge has been passed, a roller that works as a conveying unit comes into contact with the sheet-set surface to convey the sheet set.

As shown in FIG. 21, after the edge of the sheet set P is passed, the roller 36 of the conveying mechanism 35 comes into contact with the sheet surface to give the sheet set P the conveyance force. The guide member 44 and the ejection roller 56 constitutes a guide member of the turning conveyance path 57 through which the sheet set P is conveyed to the saddle stitch tray G.

Figure 22:
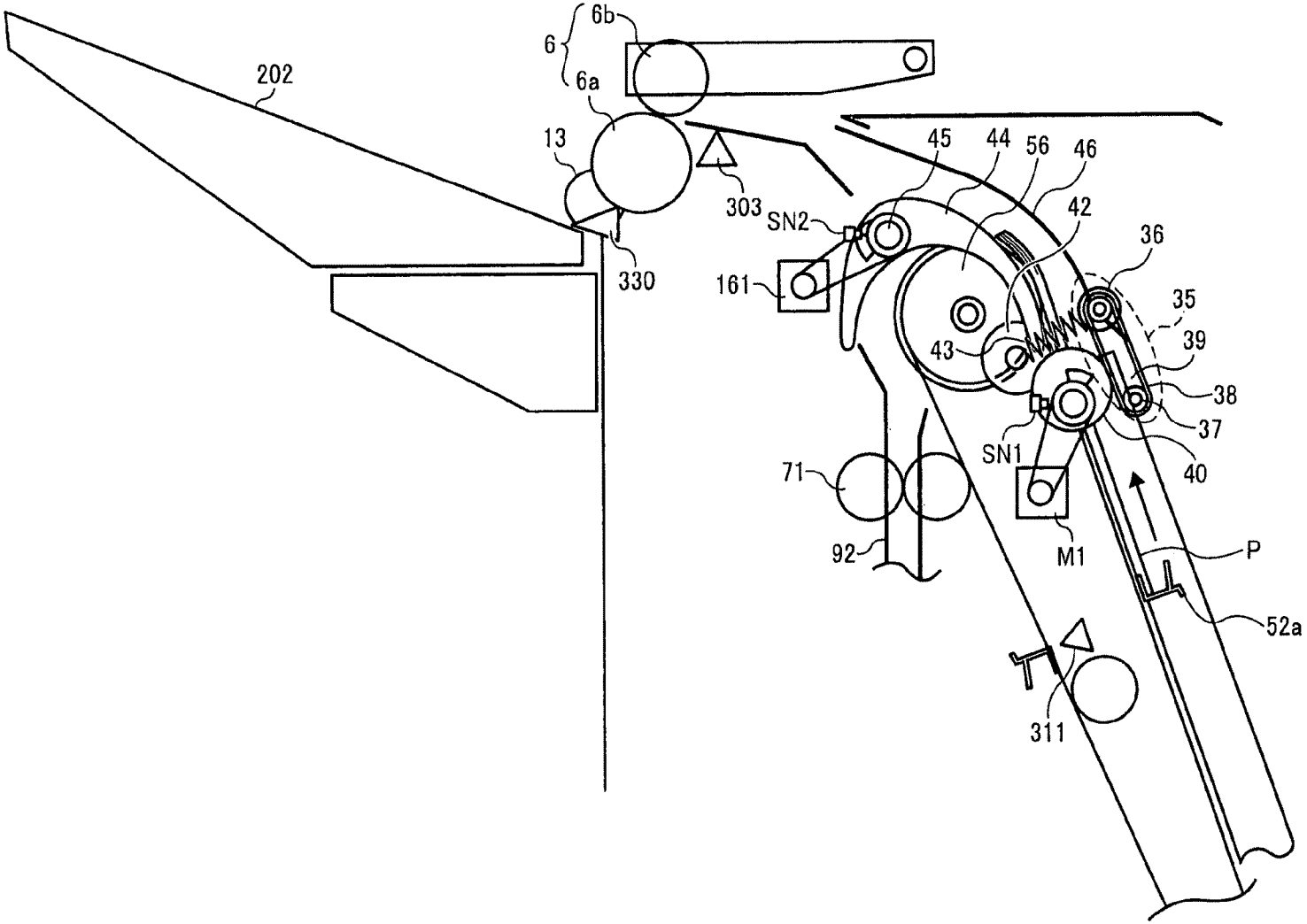
FIG. 22 is a schematic diagram that explains a situation where a guide member swings so that the guide member and a guide plate together form a conveyance path to the shift tray and the sheet set that has been aligned by the side stitch unit is conveyed to the shift tray with the trailing edge being pushed up by the ejection claw.

To convey the sheet set P from the side stitch tray F to the shift tray 202, the guide member 44 swings, as shown in FIG. 22, an angle in the clockwise direction larger than that the guide member 44 swings as shown in FIG. 21 when the sheet set P is conveyed to the saddle stitch tray G so that the guide member 44 and the guide plate 46 together form the conveyance path to the shift tray 202. The trailing edge of the sheet set P that is aligned by the side stitch tray F is pushed up by the ejection claw 52*a* and is conveyed to the shift tray 202. The conveyance force from the roller 36 of the conveying mechanism 35 is not used in this situation.

The ejection roller 56 according to the present embodiment works as a driven roller rotated associated with conveyance of, the sheet set, free from the driving shaft that drives the ejection belt 52. Alternatively, the ejection roller 56 can work as a driving roller that is driven by the ejection motor 157. If the ejection roller 56 is the driving roller, the circumferential speed of the ejection roller 56 is set faster than the circumferential speed of the ejection belt 52.

5. Saddle Stitch Tray

The saddle stitch and the half folding is performed by the saddle stitch tray G that is arranged downstream of the side stitch tray F. The sheet set is conveyed from the side stitch tray F to the saddle stitch tray G by the operation of the sheet-set deflecting mechanism. The configuration of the saddle-stitch/half-folding tray is described below.

As shown in FIG. 1, the saddle stitch tray G is arranged downstream of the sheet-set deflecting mechanism that includes the conveying mechanism 35, the guide member 44, and the ejection roller 56. The saddle stitch tray G is arranged the downstream side of the sheet-set deflecting mechanism, extending almost the vertical direction. The saddle stitch tray G includes an upper sheet-set conveyance guide plate 92 in an upper part and a lower sheet-set conveyance guide plate 91 in a lower part. The upper sheet-set conveyance guide plate 92 is attached with a pair of upper sheet-set conveyance rollers 71 in an upper part and a pair of lower sheet-set conveyance rollers 72 in a lower part. The saddle-stitch upper jogger fence 250*a* is arranged over the rollers 71 and 72 along the side surface of the upper sheet-set conveyance guide plate 92 on both sides. The saddle-stitch lower jogger fence 250*b* is arranged along the side surface of the lower sheet-set conveyance guide plate 91 on both sides. The saddle stitch stapler S2 is arranged near the saddle-stitch lower jogger fences 250*b*. The saddle-stitch upper jogger fence 250*a* and the saddle-stitch lower jogger fence 250*b* are moved in the direction orthogonal to the sheet conveying direction (sheet width direction) by a driving mechanism (not shown) for alignment. The saddle stitch stapler S2 includes two pairs of a clincher unit and a driver unit, and the pairs are arranged in the sheet width direction a predetermined distance away from each other. Although the pairs are fixed in the present embodiment, it is allowable to configure one of the pairs movably in the sheet width direction for the two-position stapling.

A movable trailing-edge fence 73 is arranged across the lower sheet-set conveyance guide plate 91. The movable trailing-edge fence 73 can move in the sheet conveying direction (the up-and-down direction in the figure) by a moving mechanism that includes a timing belt and a driving mechanism that drives the timing belt. The driving mechanism, as shown in FIG. 1, includes a driving pulley, a driven pulley, and a stepping motor that drives the driving pulley. A trailing-edge tapping claw 251 and a driving mechanism that drives the trailing-edge tapping claw 251 are arranged at the upper side of the upper sheet-set conveyance guide plate 92. The trailing-edge tapping claw 251 can move both the direction away from the sheet-set deflecting mechanism and the direction to press the trailing edge of the sheet set (side that corresponds to "trailing edge" when the sheet set enters) by rotation of a timing belt 252 and a driving mechanism that rotates the timing belt 252 (not shown). The reference numeral 326 is a home position sensor that is used to detect the home position of the trailing-edge tapping claw 251.

A half-folding mechanism is arranged in almost the center of the saddle stitch tray G and includes the folding plate 74, the folding rollers 81, and the conveyance path H through which the folded sheet set is conveyed.

5.2 Folding Plate and Operation Mechanism

Figure 23A:
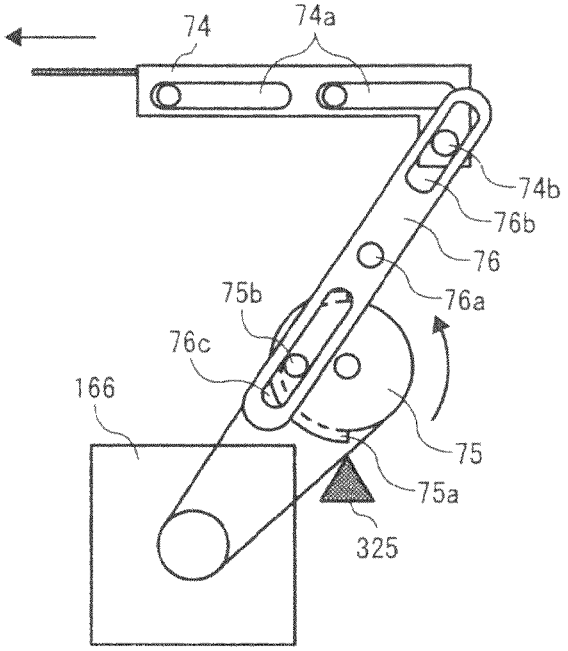
FIGS. 23A and 23B are schematic diagrams that explain operation of a half-folding mechanism.
Figure 23B:
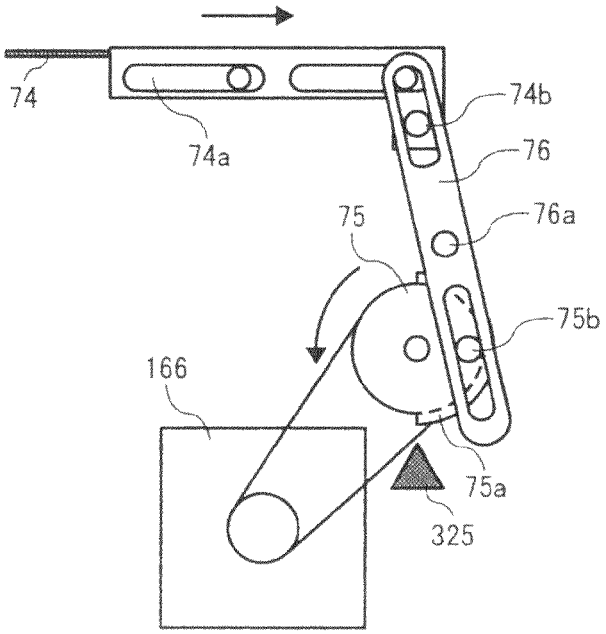

FIGS. 23A and 23B are schematic diagrams that explain a moving mechanism that moves the folding plate 74.

The folding plate 74 is supported by two shafts that are attached to both the front-side plate and the back-side plate. The shafts are movably engaged with elongated holes 74*a* of the folding plate 74 so that the folding plate 74 can move in the direction along the major axes of the elongated holes 74*a*. A shaft member 74*b* is engaged with an elongated hole 76*b* of a link arm 76. By swing of the link arm 76 about a fulcrum 76*a*, the folding plate 74 moves side to side as shown in FIGS. 23A and 23B. A shaft member 75*b* of a folding-plate driving cam 75 is movably engaged with an elongated hole 76*c* of the link arm 76. By rotation of the folding-plate driving cam 75, the link arm 76 swings. The folding-plate driving cam 75 is rotated in the direction indicted by the arrow shown in FIGS. 23A and 23B by a folding-plate driving motor 166. The stop position of the folding-plate driving cam 75 is controlled by detecting both ends of a semicircular shielding unit 75*a* using a folding-plate HP sensor 325.

FIG. 23A illustrates a situation where the folding plate 74 is in the home position, i.e., the entire folding plate 74 is out of a sheet-set accommodating range of the saddle stitch tray G. By rotation of the folding-plate driving cam 75 in the direction indicated by the arrow, the folding plate 74 moves in the direction indicated by the arrow into the sheet-set accommodating range of the saddle stitch tray G. FIG. 23B illustrates positions of the relevant parts when the center of the sheet set is inserted from the saddle stitch tray G into the nip between the folding rollers 81. By rotation of the folding-plate driving cam 75 in the direction indicated by the arrow, the folding plate 74 moves in the direction indicated by the arrow from the sheet-set accommodating range of the saddle stitch tray G.

Although it is assumed that a set of sheets are half-folded in the present embodiment, it is possible to fold a single sheet. The single sheet, of course, does not need to be subjected to the saddle stitch. The single sheet is conveyed to the saddle stitch tray G immediately, folded by the folding plate 74 and the folding rollers 81, and then discharged to the lower tray 203 through a pair of lower discharge rollers 83. The reference numeral 323 is a folding-unit passage sensor that is used to detect a half-folded sheet; the reference numeral 321 is a sheet-set detecting sensor that detects whether the sheet set arrives at the half-folding position; and the reference numeral 322 is a movable trailing-edge fence home position sensor that detects the home position of the movable trailing-edge fence 73.

In the present embodiment, a detection lever 501 that is used to detect a height of the half-folded sheet sets stacked on the lower tray 203 is provided swingably about a fulcrum 501*a*. The angle of the detection lever 501 is detected by a sheet-surface sensor 505. The moving up/down operation and the over-flow detection of the lower tray 203 are performed using the detection result.

5.3 Mode and Manner of Discharge

In the present embodiment, any of the following five post-processing modes is set and the sheet is discharged in a manner specified by the mode. The post-processing modes include:

No-staple mode a: Sheets are discharged to the upper tray 201, passed through the conveyance paths A and B.

No-staple mode b: Sheets are discharged to the shift tray 202, passed through the conveyance paths A and C.

Sort/stack mode: Sheets are discharged to the shift tray 202, passed through the conveyance paths A and C. The shift tray 202 swings in the direction orthogonal to the sheet discharging direction after receiving the last sheet of each sheet set so that the sheets are sorted.

Staple mode: Sheets are conveyed to the side stitch tray F, passed through the conveyance paths A and D and are subjected to alignment and stapling. After that, the sheet sets are discharged to the shift tray 202, passed through the conveyance path C.

Saddle-stitch binding mode: Sheets are conveyed to the side stitch tray F, passed through the conveyance paths A and D and are subjected to alignment and saddle-stapling. After that, the sheet sets are then half-folded by the saddle stitch tray G. The sheet sets are discharged to the lower tray 203, passed through the conveyance path H. The operation of each mode is described below.

After passed through the conveyance path A, sheets are conveyed to the conveyance path B by sorting operation of the switching claw 15 and then discharged to the upper tray 201 by the conveyance rollers 3 and the upper discharge rollers 4. The status of the discharging sheet is monitored by an upper discharging-sheet sensor 302 that is arranged near the upper discharge rollers 4 to detect the discharging sheet.

After passed through the conveyance path A, sheets are conveyed to the conveyance path C by sorting operation of the switching claws 15 and 16 and then discharged to the shift tray 202 by the conveyance rollers 5 and the shift discharge rollers 6. The status of the discharging sheet is monitored by the shift discharging-sheet sensor 303 that is arranged near the shift discharge rollers 6 to detect the discharging sheet.

Sheets are conveyed and discharged to the shift tray 202 along the same manner as sheets are conveyed in the no-staple mode b. The shift tray 202 swings in the direction orthogonal to the sheet discharging direction after receiving the last sheet of each sheet set so that the sheets are sorted.

After passed through the conveyance path A, sheets are conveyed to the conveyance path D by sorting operation of the switching claws 15 and 16 and then discharged to the side stitch tray F by the conveyance rollers 7, 9, and 10 and the staple discharge rollers 11. The side stitch tray F aligns the sheets coming from the staple discharge rollers 11 one by one and staples, when the number of the stacked sheets reaches a predetermined value, the sheets using the side-stitch stapler S1. After that, the stapled sheet set is conveyed downstream by the ejection claw 52*a* and is discharged onto the shift tray 202 by the shift discharge rollers 6. The status of the discharging sheet is monitored by the shift discharging-sheet sensor 303 that is arranged near the shift discharge rollers 6 to detect the discharging sheet.

If the staple mode is selected, as shown in FIG. 6, the jogger fences 53 move from the home positions to the waiting positions, which are 7 mm outside the both side edges of the sheet that is being discharged to the side stitch tray F. When the sheet is conveyed by the staple discharge rollers 11 and the trailing edge of the sheet passes a staple discharging-sheet sensor 305, the jogger fences 53 move 5 mm inside from the waiting positions and stop at the positions. The staple discharging-sheet sensor 305 detects passage of the trailing edge of the sheet and outputs the signal to a CPU 360 (see FIG. 33). The CPU 360 counts the number of pulses that are received after the signal is received from a staple conveying motor (not shown) that drives the staple discharge rollers 11. When the CPU 360 counts the pulses up to a predetermined number, the CPU 360 turns the tapping SOL 170 ON. The reverse roller 12 swings like a pendulum by ON/OFF of the tapping SOL 170. When the tapping SOL 170 turns ON, the reverse roller 12 swings downward and taps the sheet so that the sheet comes abut against the trailing-edge fences 51 for alignment. Whenever a sheet to be accommodated in the side stitch tray F passes the entrance sensor or the staple discharging-sheet sensor 305, the signal is input to the CPU 360 and the count of the sheets increases.

The jogger fences 53 are moved by the jogger motor 158 2.6 mm inside a predetermined period after the tapping SOL 170 turned OFF and stop at the positions, which results in the sheet aligned side to side. After that, the jogger fences 53 move 7.6 mm outside to the waiting positions and waits at the positions for the next sheet. The series of movements is repeated until the last page. After that, the jogger fences 53 move 7 mm inside and stop at the positions to hold the both side edges of the sheet set for the stapling. The side-stitch stapler S1 driven by a stapling motor (not shown) starts the stapling process after a predetermined period. If the two-position stapling is selected, after a first position is stapled, the stapler moving motor 159 moves the side-stitch stapler S1 to a target position along the sheet trailing edge and the side-stitch stapler S1 staples a second position. If three or more positions are to be stapled in total, the above-described operation is repeated.

When the stapling process is completed, the ejection motor 157 drives the ejection belt 52. At the same time, the discharge motors drives and the shift discharge rollers 6 rotate to receive the sheet set that is lifted up using the ejection claw 52*a*. The jogger fences 53 are controlled variously depending on the size and the number of the sheets. For example, if the number of the stapled sheets is smaller than a predetermined number or the size is smaller than a predetermined size, the sheet set is conveyed in such a manner that the trailing edge is supported by the ejection claw 52*a* and the sheet side is held by the jogger fences 53. Predetermined pulses after detection by the sheet presence/absence sensor 310 or the ejection-belt HP sensor 311 detects the sheet set, the jogger fences 53 move 2 mm outside, thereby releasing the sheet set. The predetermined pulses are set so that the jogger fences 53 releases the sheet set during a period between when the ejection claw 52*a* comes into contact with the sheet trailing edge and the ejection claw 52*a* moves up to the end of the jogger fences 53. If the number of the stapled sheets is larger than the predetermined number or the size is larger than the predetermined size, the sheet set is lifted up with the jogger fences 53 being 2 mm outside. In any of the cases, after the sheet set passes through the jogger fences 53, the jogger fences 53 move 5 mm outside to the waiting positions for the next sheet. It is possible to adjust a pressure onto the sheet set for holding by adjusting a distance between the jogger fences 53 and the sheet sides.

Figure 24:
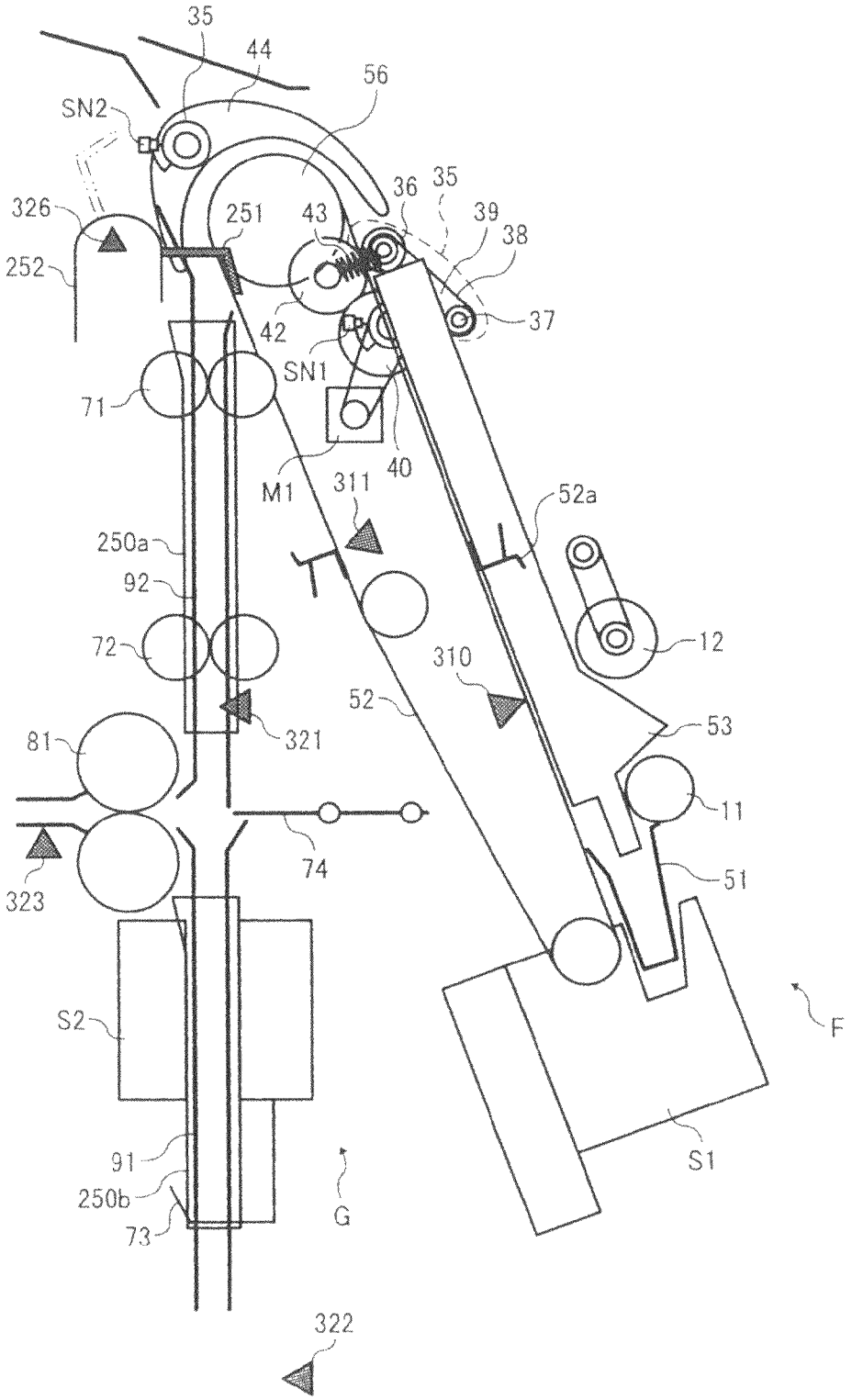
FIG. 24 is a front view of the side stitch tray and the saddle stitch tray.
Figure 25:
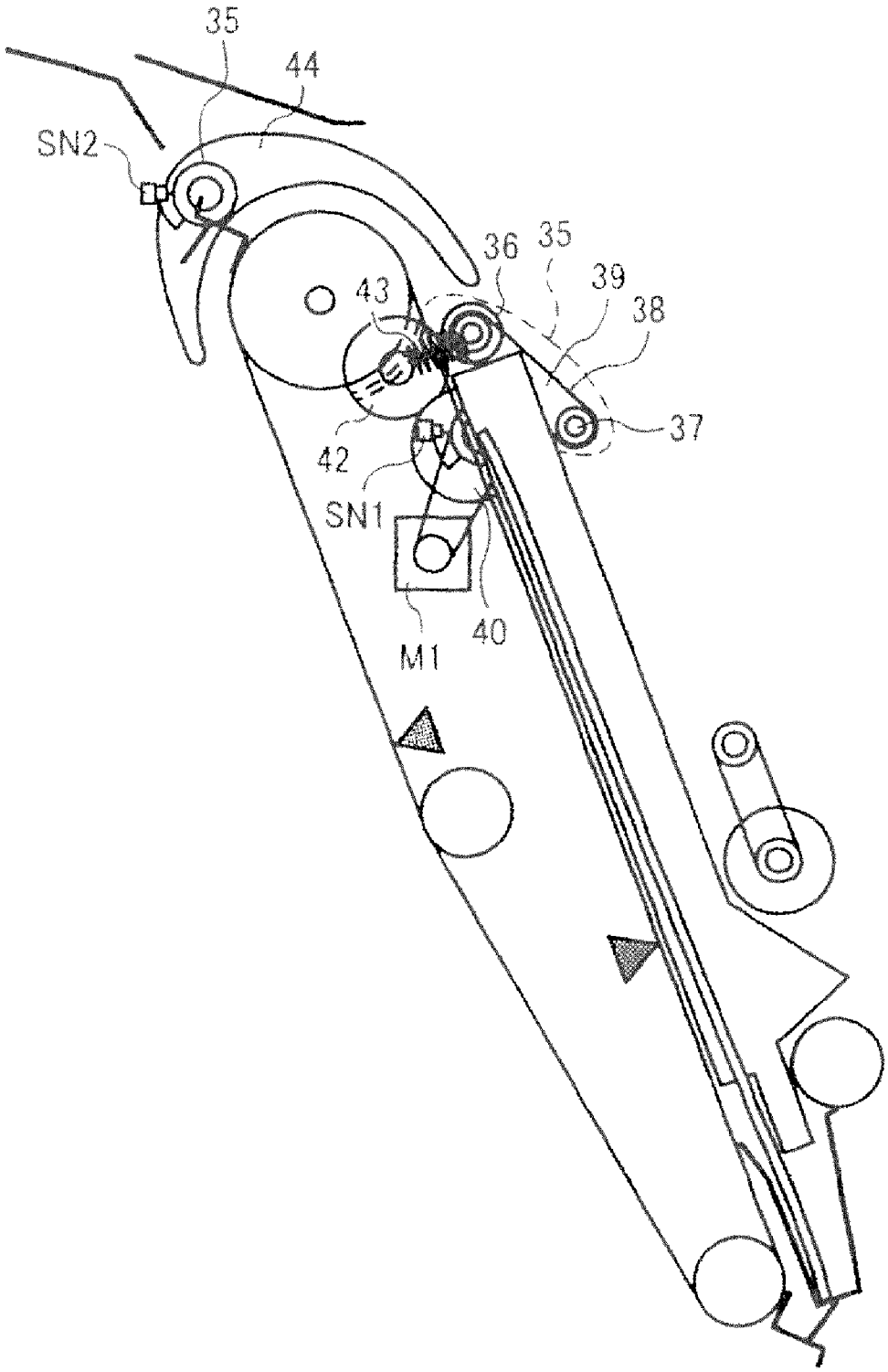
FIG. 25 is a schematic diagram that illustrates a situation where the sheet set is stacked on the side stitch tray in an aligned manner.

FIG. 24 is a front view of the side stitch tray F and the saddle stitch tray G. FIGS. 25 to 32 are schematic diagrams that explain the operation of the saddle-stitch binding mode.

As shown in FIG. 1, after passed through the conveyance path A, sheets are conveyed to the conveyance path D by sorting operation of the switching claws 15 and 16 and then discharged to the side stitch tray F shown in FIG. 24 by the conveyance rollers 7, 9, and 10, and the staple discharge rollers 11. The side stitch tray F aligns the sheets coming from the staple discharge rollers 11 one by one in the same manner as the staple mode described in the section (4). The part of the operation of the saddle-stitch binding mode immediately before stapling is the same as the corresponding part of the staple mode (see FIG. 25 where the sheet set is aligned by the trailing-edge fences 51).

Figure 26:
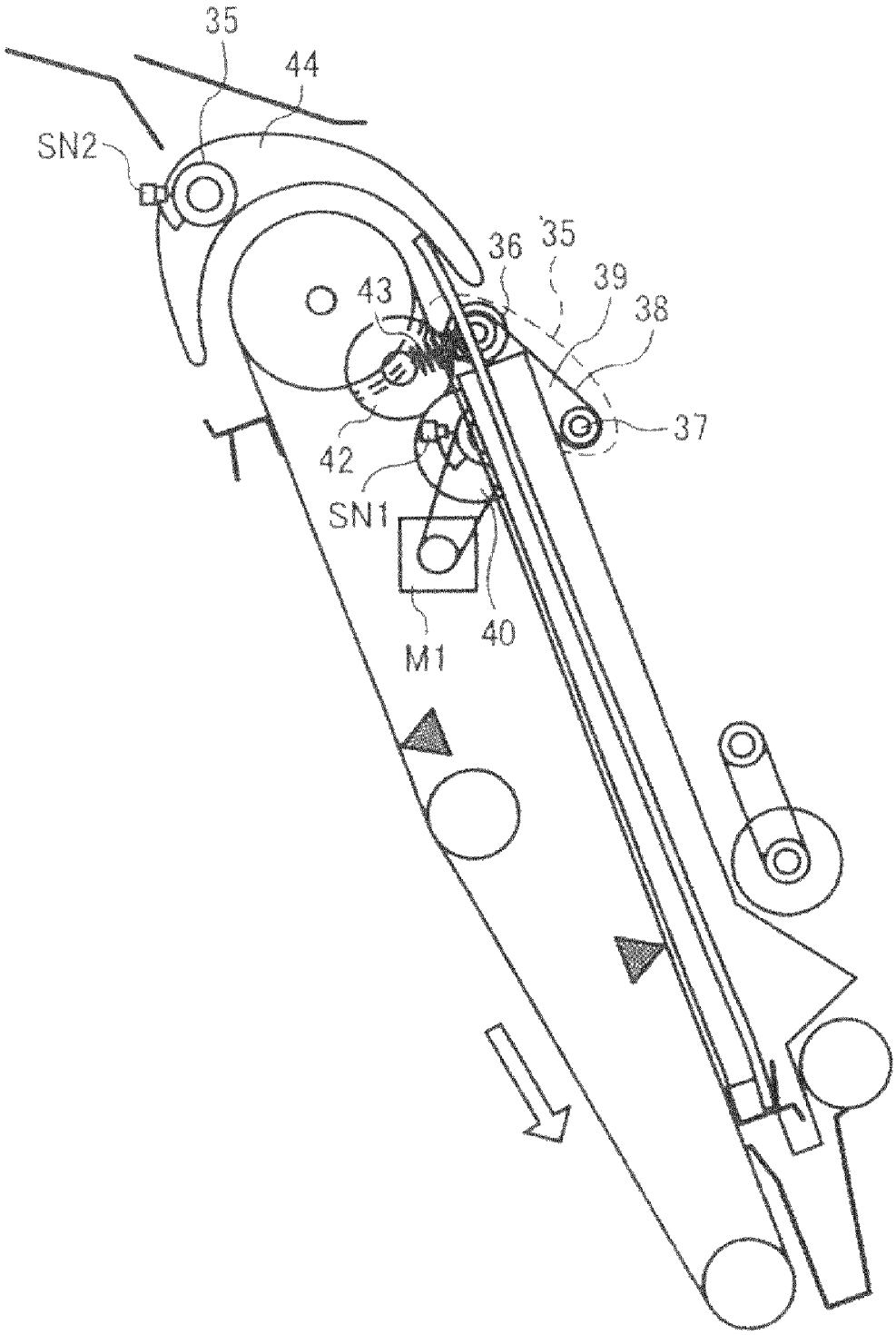
FIG. 26 is a schematic diagram that illustrates a situation subsequent to the situation shown in FIG. 25 where the ejection claw starts pushing up the sheet set.
Figure 27:
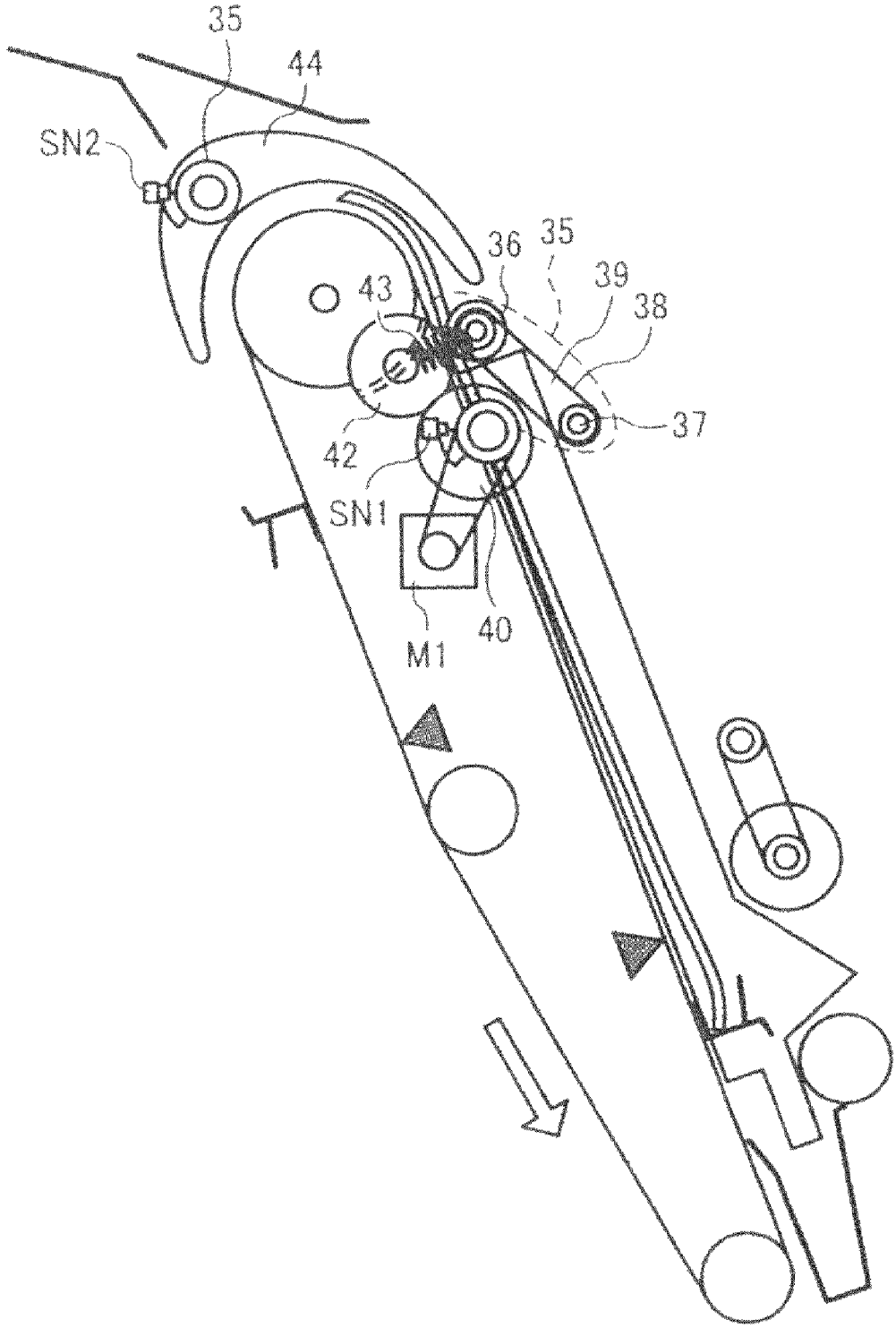
FIG. 27 is a schematic diagram that illustrates a situation subsequent to the situation shown in FIG. 26 where the sheet set is conveyed near the entrance of the sheet deflecting mechanism.

After the sheet set is roughly aligned by the side stitch tray F, the trailing edge of the sheet set is pushed up by the ejection claw 52*a* as shown in FIG. 26. The sheet set is passed between the roller 36 and the driven roller 42, which are apart from each other so that they cannot interfere with the passage of the leading edge of the sheet set, and conveyed to the position between the inner surface of the guide member 44 and the outer circumference of the ejection roller 56. After that, the motor M1 and the cam 40, which are the swinging mechanism, closes the roller 36 and therefore the leading edge of the sheet set is nipped between the roller 36 and the driven roller 42, pressed by a predetermined force. The roller 36 rotates by a driving force received from the timing belt and the ejection roller 56 also rotates. The sheet set is conveyed downstream along the path to the saddle stitch tray G as shown in FIG. 27 by the rotation of the roller 36 and the ejection roller 56. The ejection roller 56 is provided to the driving shaft of the ejection belt 52 and is driven synchronized with the ejection belt 52.

Figure 28:
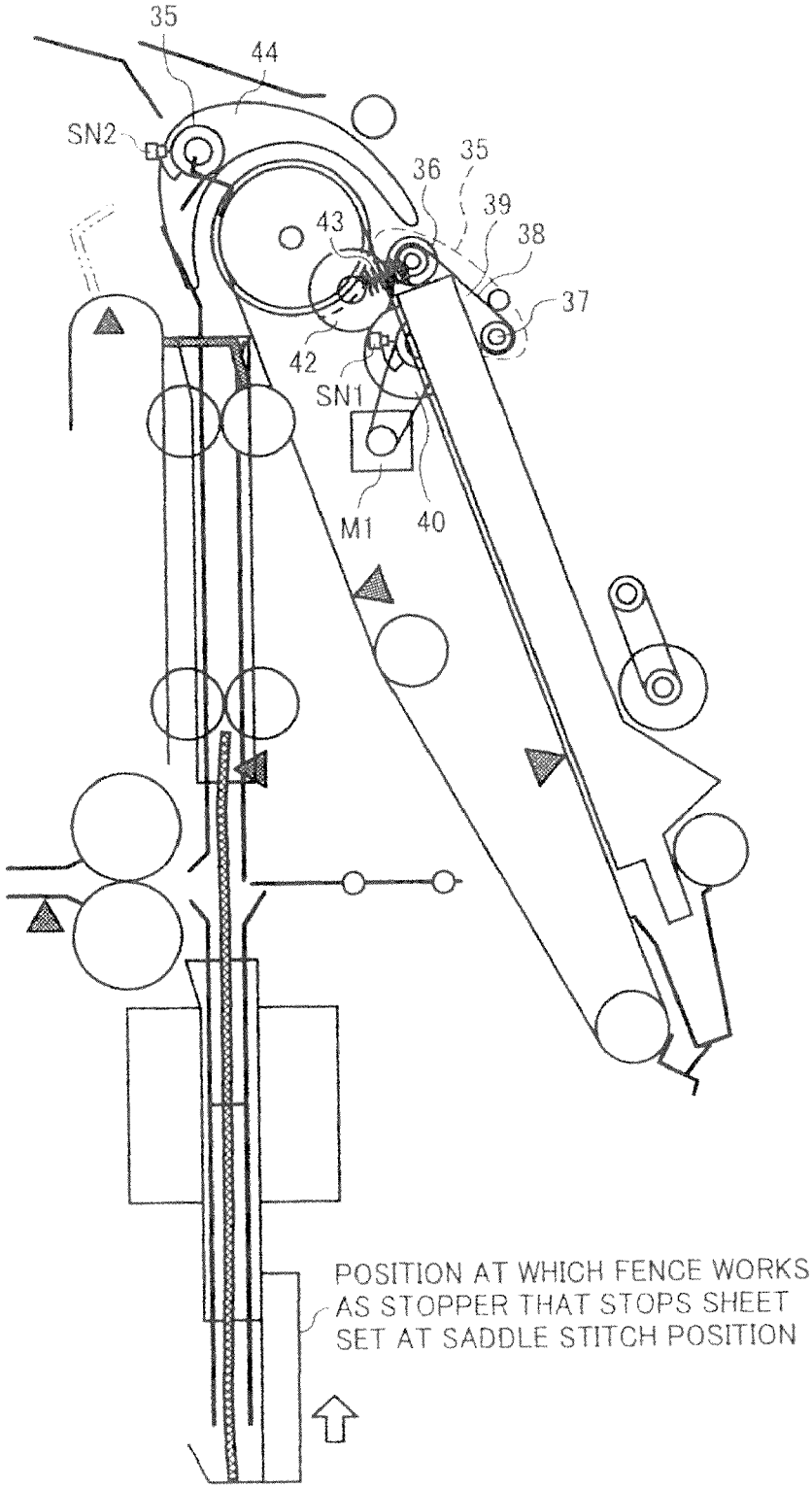
FIG. 28 is a schematic diagram that illustrates a situation subsequent to the situation shown in FIG. 27 where the sheet set is conveyed to the saddle stitch tray.

The sheet set is conveyed from the position shown in FIG. 27 to the position shown in FIG. 28. After the sheet set is conveyed into the saddle stitch tray G, the sheet set is conveyed by the upper sheet-set conveyance rollers 71 and the lower sheet-set conveyance rollers 72. At this time, the movable trailing-edge fence 73 is waiting for the sheet set at the stop position that is variable depending on the length of the sheet set in the sheet conveying direction. When the leading edge of the sheet set comes into contact with the waiting movable trailing-edge fence 73, i.e., the sheet set is stacked on the saddle stitch tray G, the nip by the movable trailing-edge fence 73 is released as shown in FIG. 28 and the trailing-edge tapping claw 251 taps the trailing edge of the sheet set so that the sheet set is subjected to final alignment. This is because, although the sheet set is roughly aligned by the side stitch tray F, the sheet set can be unaligned during the passage before it comes into contact with the movable trailing-edge fence 73. Therefore, it is necessary to perform the final alignment using the trailing-edge tapping claw 251.

Figure 29:
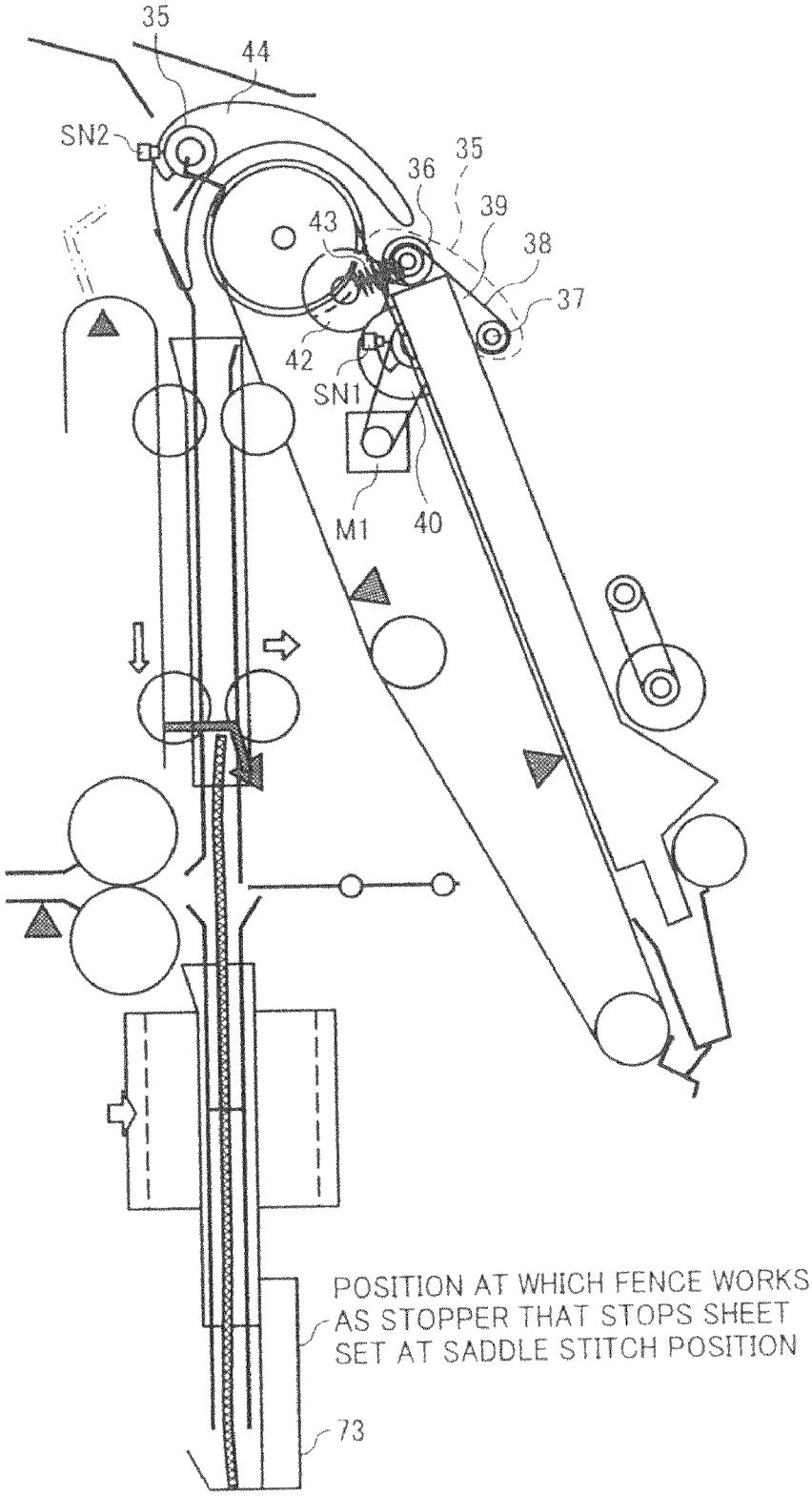
FIG. 29 is a schematic diagram that illustrates a situation subsequent to the situation shown in FIG. 28 where the sheet set is aligned by the saddle stitch tray.

The relevant parts shown in FIG. 29 are in their saddle stitch positions. The movable trailing-edge fence 73 is waiting for the sheet set at the saddle stitch position. The saddle-stitch upper jogger fence 250*a* and the saddle-stitch lower jogger fence 250*b* perform the final alignment in the width direction. The saddle stitch stapler S2 staples the center of the sheet set.

The position of the movable trailing-edge fence 73 is adjusted under the pulse control of the movable trailing-edge fence HP sensor 322. The position of the trailing-edge tapping claw 251 is adjusted under the pulse control of the trailing-edge tapping claw HP sensor 326.

Figure 30:
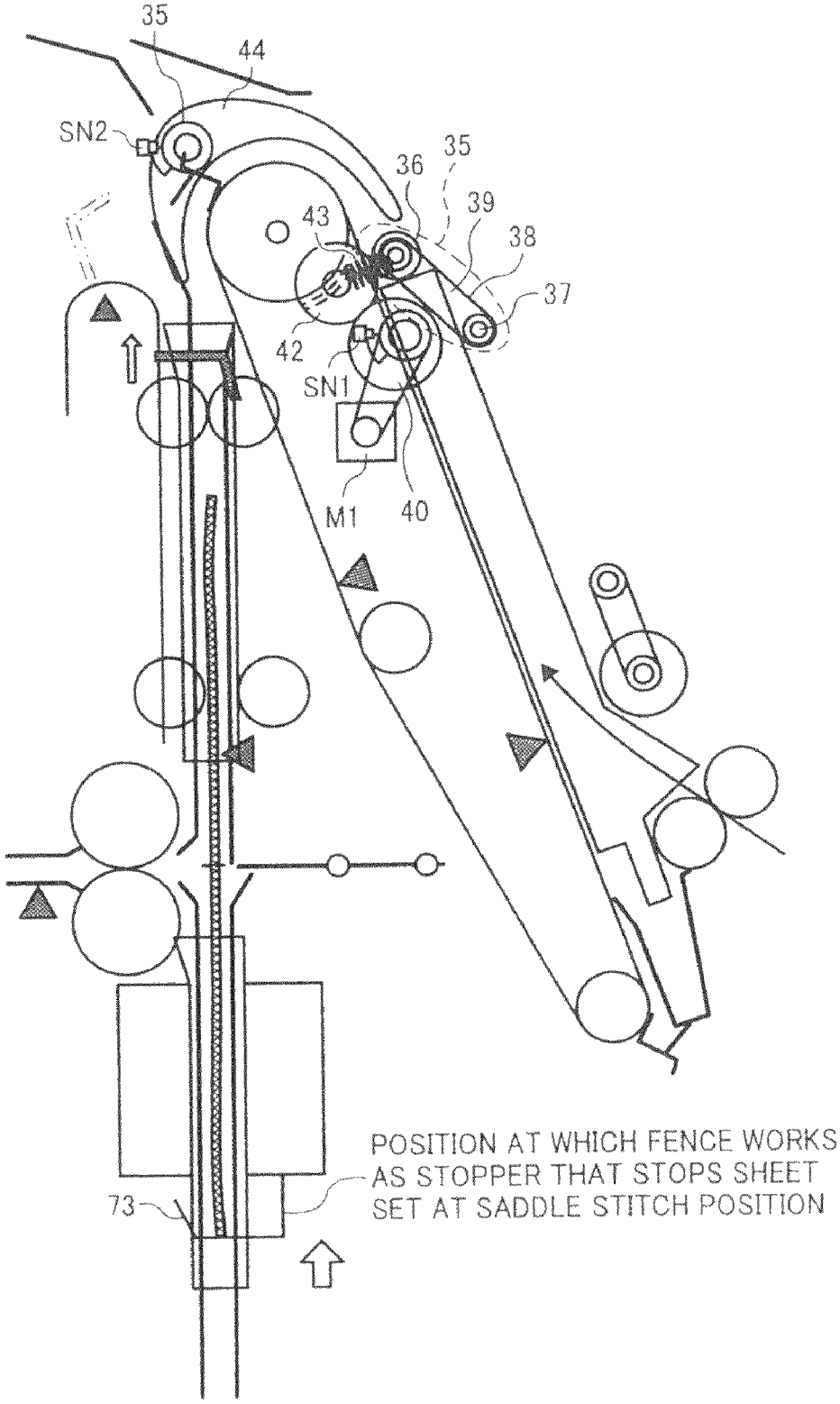
FIG. 30 is a schematic diagram that illustrates a situation subsequent to the situation shown in FIG. 29 where the sheet set is pushed up to a half-folding position.
Figure 31:
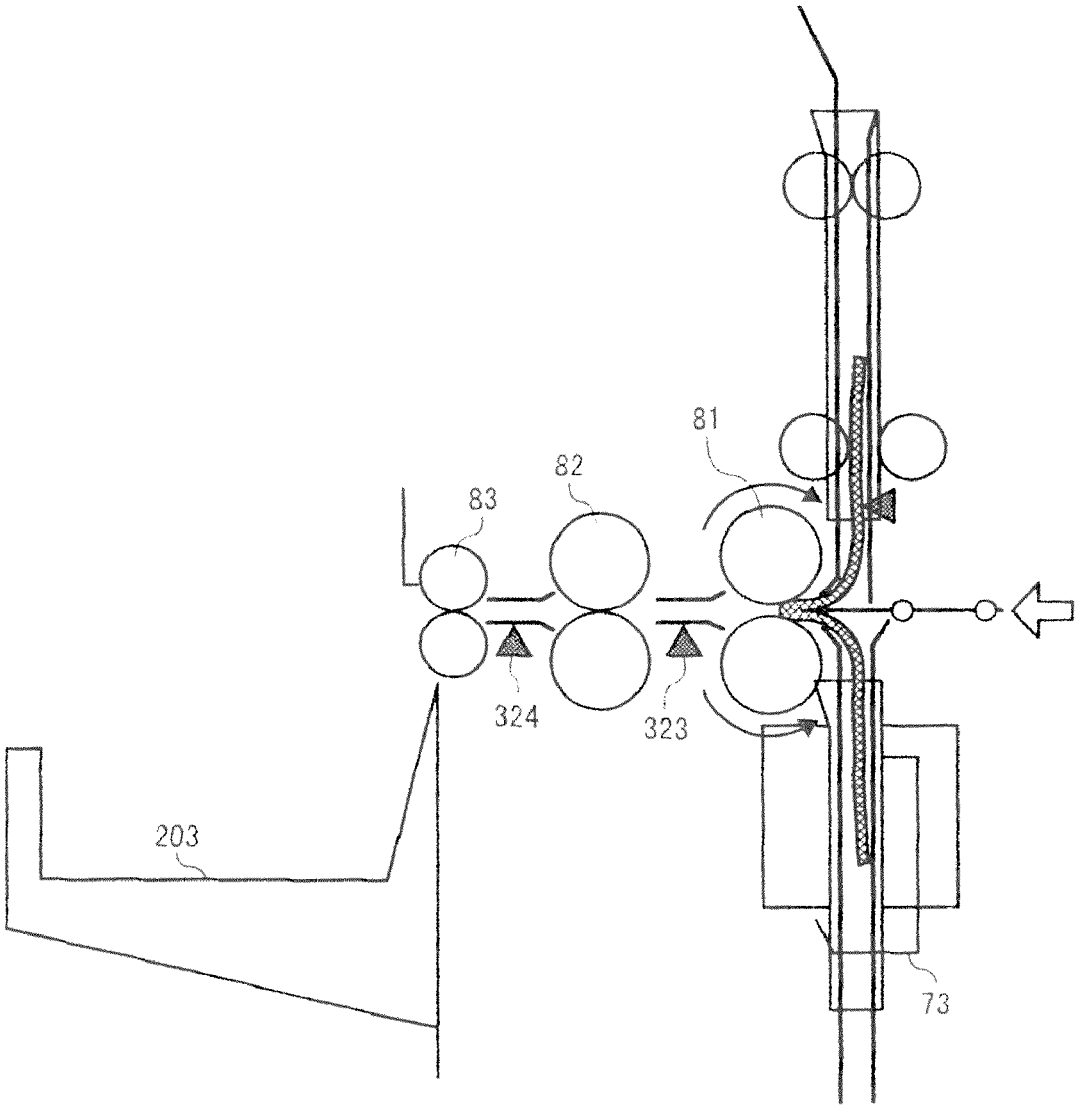
FIG. 31 is a schematic diagram that illustrates a situation subsequent to the situation shown in FIG. 30 where a half-folding process starts.

As shown in FIG. 30, with the nip by the lower sheet-set conveyance rollers 72 being released, the saddle-stitched sheet set is conveyed, associated with moving of the movable trailing-edge fence 73, upward to such a position that the half-folded position is aligned with the folding plate 74. After that, as shown in FIG. 31, the folding plate 74 presses part near the stapled positions in the direction substantially orthogonal to the sheet surface into the nip between the folding rollers 81 that is arranged in the direction in which the folding plate 74 moves. The rotating folding rollers 81 nip the sheet set and press-convey the sheet set, thereby making a crease on the center of the sheet set. In this manner, because the saddle-stitched sheet set is moved up to prepare for the folding process, the sheet set is surely conveyed only by moving of the movable trailing-edge fence 73. If the sheet set is moved down to prepare for the folding process, because it is difficult to surely convey the sheet set only by moving of the movable trailing-edge fence 73, an additional unit, such as a conveyance roller, is required, which makes the configuration complicated.

Figure 32:
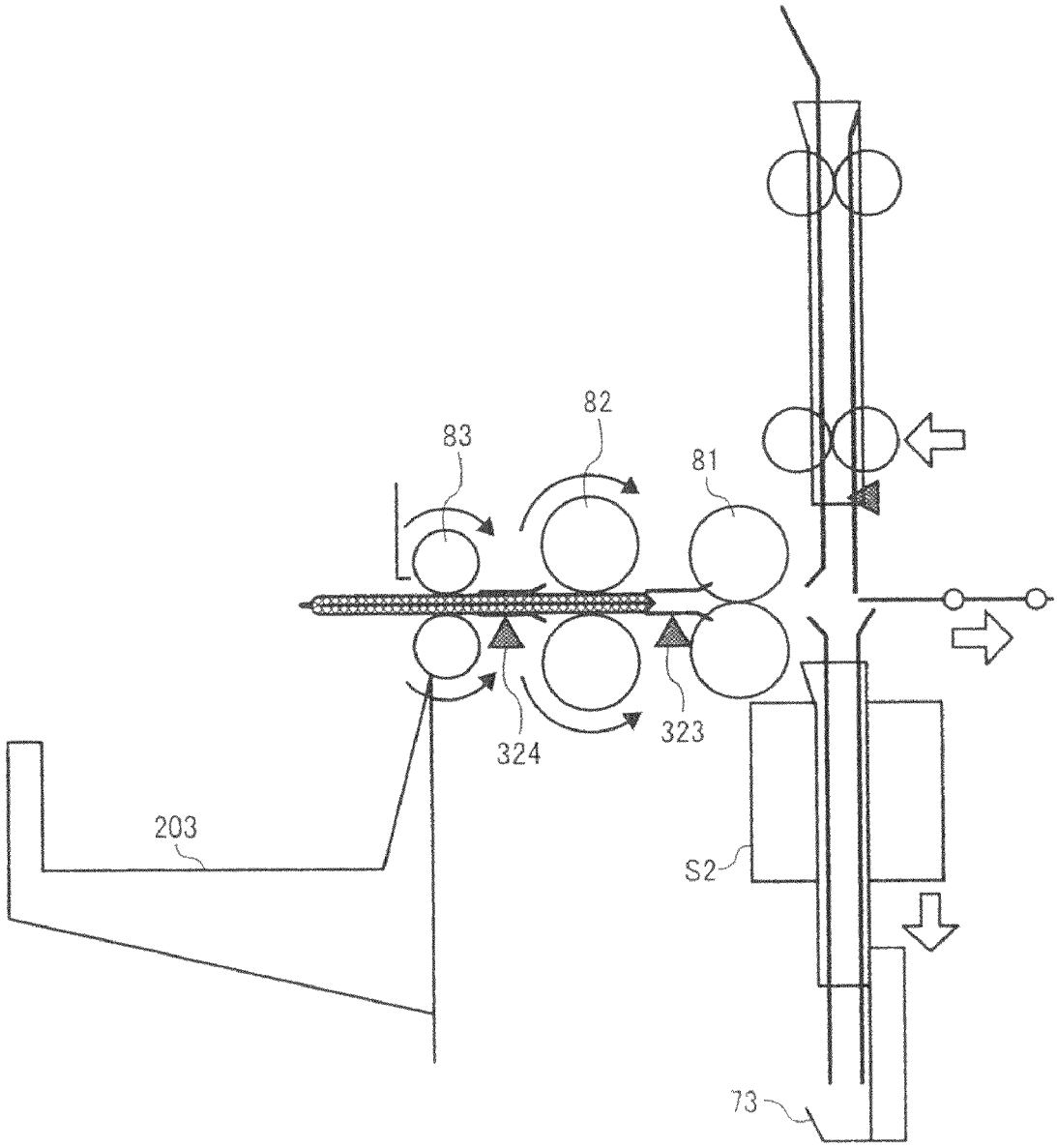
FIG. 32 is a schematic diagram that illustrates a situation subsequent to the situation shown in FIG. 31 where the sheet set is subjected to a process for making the crease stronger at a folding-roller position.

As shown in FIG. 32, after the sheet set is folded, the crease is made stronger by a pair of second folding rollers 82 and then the sheet set is discharged onto the lower tray 203 by the lower discharge rollers 83. When the trailing edge of the sheet set is detected by the folding-unit passage sensor 323, the folding plate 74 and the movable trailing-edge fence 73 move back to their home positions and the nip between the lower sheet-set conveyance rollers 72 is released for entrance of the next sheet. If the next job has the same number of sheets with the same size, the movable trailing-edge fence 73 can move back to the position shown in FIG. 24 and wait for the next sheet set. The second folding rollers 82 shown in FIGS. 31 and 32 are not shown in FIG. 1. Whether the second folding rollers 82 are arranged is determined depending on the setting conditions.

Figure 33:
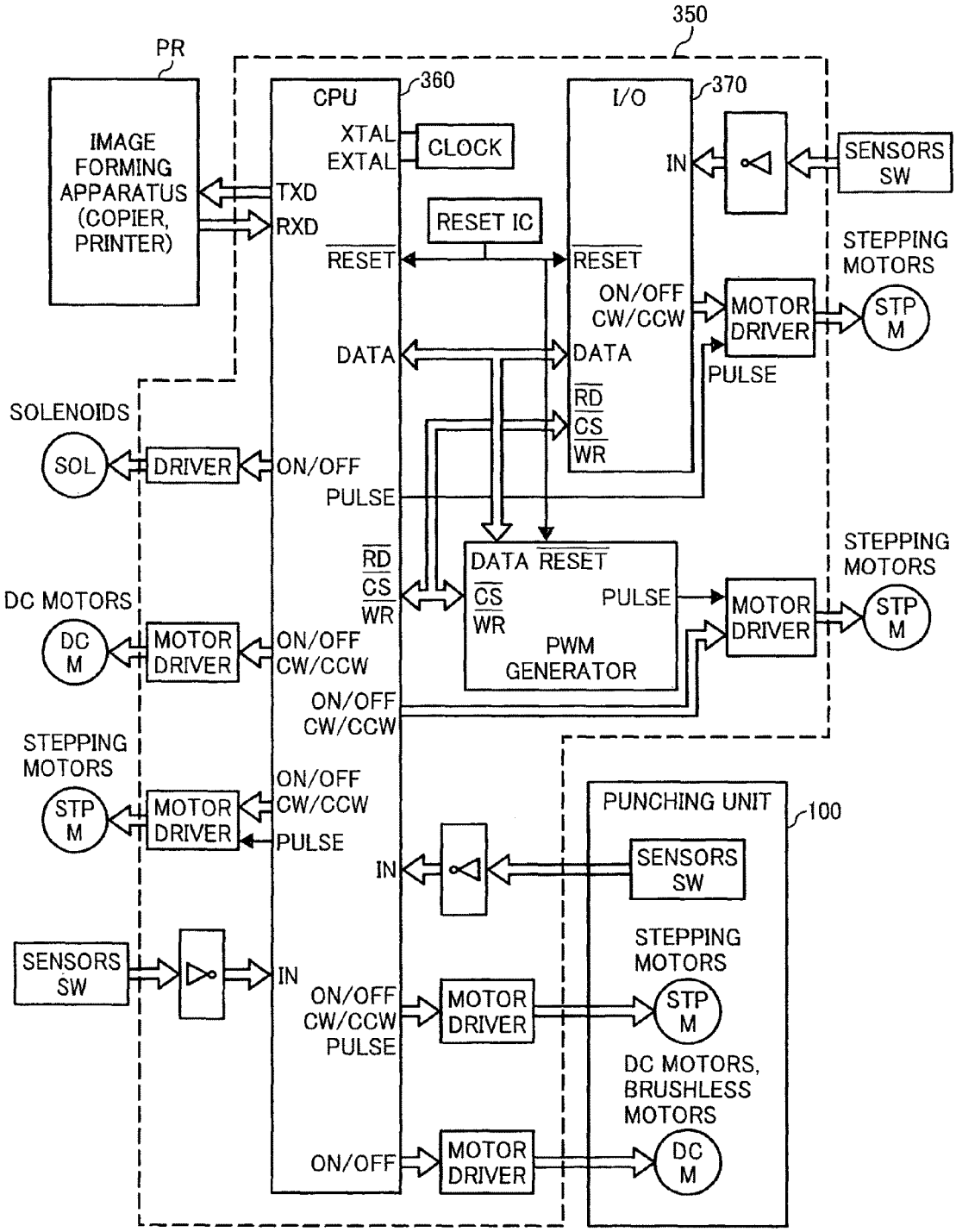
FIG. 33 is a block diagram of a control system according to the present embodiment.

FIG. 33 is a block diagram of the control system according to the present embodiment. The control circuit 350 is a micro computer that includes, as shown in FIG. 33, the CPU 360, an I/O interface 370, etc. Signals of various switches on the control panel (not shown) of the image forming apparatus PR and various sensors, such as the sheet-surface detecting sensors 330, a first sensor 621, and a second sensor 622, are input to the CPU 360 via the I/O interface 370. The CPU 360 controls operation of the following units using the input signals, such as the tray moving-up/down motor 168 that moves up and down the shift tray 202, the discharge guide-plate open/close motor 167 that opens and close the open/close guide plate, the shift motor 169 that moves the shift tray 202, the reverse roller motor that drives the reverse roller 12, various solenoids including the tapping SOL 170 and etc., the conveying motors that drive the respective conveyance rollers, the discharge motors that drive the respective discharge rollers, the ejection motor 157 that drives the ejection belt 52, the stapler moving motor 159 that moves the side-stitch stapler S1, the slant motor 160 that rotates the side-stitch stapler S1 the slant angle, the jogger motor 158 that moves the jogger fences 53, the sheet-set turning-point driving motor 161 that rotates the guide member 44, the sheet-set conveying motor that drives the ejection roller 56 to convey the sheet set, the trailing-edge-fence moving motor that moves the movable trailing-edge fence 73, the folding-plate driving motor 166 that moves the folding plate 74, the folding-roller driving motor that drives the folding rollers 81, and etc. Pulse signals of the staple conveying motor (not shown) that drives the staple discharge rollers are input to the CPU 360 and the CPU 360 counts the pulse signals. The tapping SOL 170 and the jogger motor 158 are controlled using the result of the counting.

The image forming apparatus PR includes a control circuit on which various control-circuit constituents, such as a CPU, a ROM, a RAM, and an ASIC, are mounted. With this configuration, the CPU reads a program from the ROM, loads the program on the RAM that is a work area and a data buffer, and performs the following control according to the present embodiment.

Figure 34:
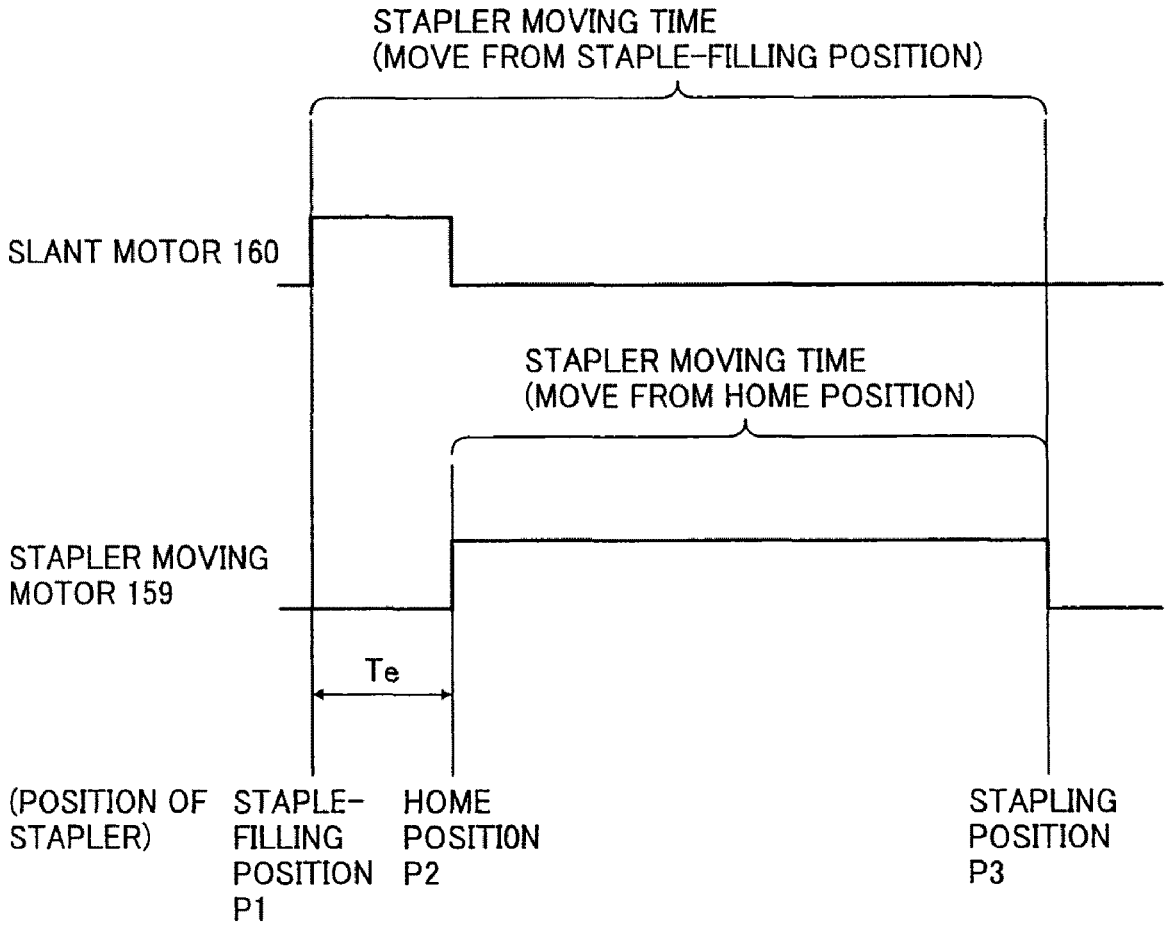
FIG. 34 is a timing chart of timing to move from a staple-filling position to a stapling position and timing to move from a home position to the stapling position for comparison.

FIG. 34 is a timing chart of timing to move from the staple-filling position to the stapling position and timing to move from the home position to the stapling position for comparison. When staple empty is detected (the side-stitch stapler S1 has only a small number of staples), the side-stitch stapler S1 is moved to a staple-filling position P1. More particularly, the side-stitch stapler S1 is moved by the stapler moving motor 159 that can rotate both forward and rearward to the home position that is detected by the stapler moving HP sensor 312 as shown in FIG. 13 and then is rotated by the slant motor 160 shown in FIG. 14 to the staple-filling position P1. The angle of rotation is determined by the amount of rotation of the slant motor 160 from a stapler slant home position sensor 313. Because the side-stitch stapler S1 is rotated, the user can easily perform the staple replacement from the front side of the sheet post-processing device.

As described above, the side-stitch stapler S1 is driven by the stapler moving motor 159 that can rotate forward and rearward via the timing belt and moves in the sheet width direction to a target position on the sheet edge for stapling. The stapler moving HP sensor 312 that detects a home position P2 of the side-stitch stapler S1 is arranged at an end of the moving range. The moving to the stapling position in the sheet width direction is controlled by a moving distance of the side-stitch stapler S1 away from the home position P2. The time that it takes for the moving is usually equal to the time that the side-stitch stapler S1 needs to move in the sheet width direction from the staple-filling position P1 to the target position (stapling position P3). However, if the side-stitch stapler S1 is in the above-described staple-filling position, an additional time Te is needed that corresponds to the time that the side-stitch stapler S1 needs to rotate back to the home position P2 as shown in FIG. 34. That is, the interval between the operation request and the sheet supply is equal to the sum of the time that it takes to move from the home position P2 to the stapling position P3 and the additional time Te.

As for the staple replacement, when the image forming apparatus PR supplies a sheet to the sheet post-processing device PD, it is necessary for the image forming apparatus PR to notify the sheet post-processing device PD of the selected post-processing mode and supply the sheet a specified time Tw after. If moving of the stapler from the staple-filling position P1 is taken into consideration, there is the necessity to set the specified time Tw to the time Te, which is the time required to move from the staple-filling position P1; therefore, it takes a longer time than usual.

Figure 35:
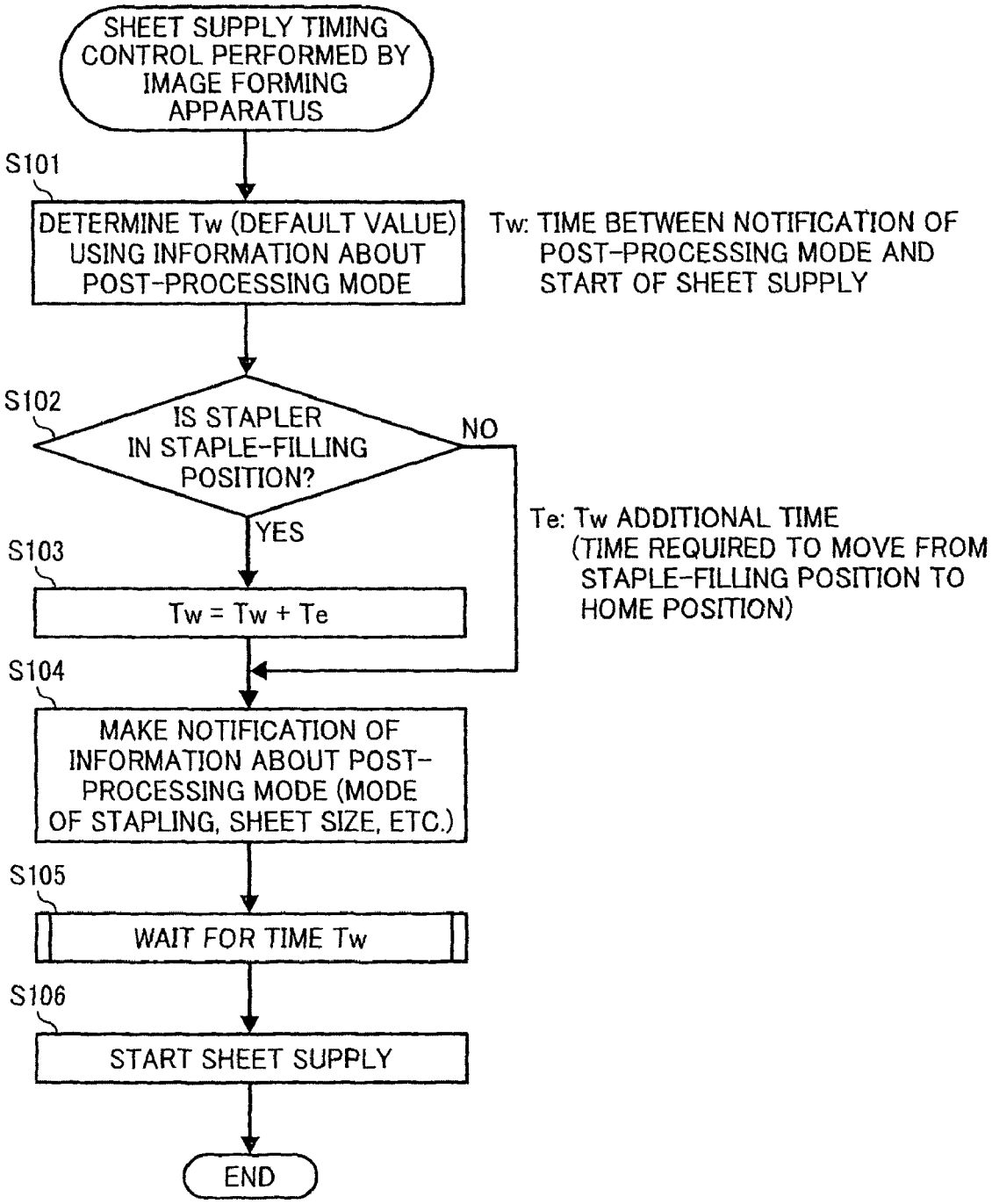
FIG. 35 is a flowchart of a sheet supply timing control process to set timing to supply a sheet from the image forming apparatus to the sheet post-processing device.

FIG. 35 is a flowchart of a process performed by the CPU under this situation, i.e., an example how to set sheet supply timing to supply the sheet from the image forming apparatus PR to the sheet post-processing device PD. As shown in FIG. 35, the specified time Tw (default value) is determined using information about the post-processing mode (Step S101). The post-processing modes of the present embodiment include, as described above, the no-staple mode a, the nom-staple mode b, the sort/stack mode, the staple mode, the saddle-stitch binding mode and further includes a flat stack mode in which the sheets are discharged without being subjected to alignment by the stapling tray and a proof discharge mode. Because the process is related to the side stitch, the single-position stapling or the two-position stapling is assumed in the following description. In a case of the single-position stapling, the staple-filling position and the upper-end position are assumed. Because different stapling positions are specified depending on the modes, the moving time is variable depending on the selected mode. Moreover, because the stapling position is also variable depending on the sheet size, the moving time is variable depending on the selected sheet size.

When the specified time Tw is determined at Step S101, the CPU checks whether the side-stitch stapler S1 is in the staple-filling position P1 (Step S102). If the side-stitch stapler S1 is in the staple-filling position P1 (Yes at Step S102), the CPU adds the additional time Te to the specified time Tw (Step S103) and notifies the sheet post-processing device PD of the information about the post-processing mode (Step S104). The image forming apparatus PR waits for the specified time Tw (Step S105) and then starts the sheet supply (Step S106).

If the side-stitch stapler S1 is not in the staple-filling position P1 (the side-stitch stapler S1 is in the home position P2) (No at Step S102), the process control goes to Step S104, skipping Step S103 and the CPU notifies the sheet post-processing device PD of the information about the post-processing mode and performs subsequent processes. The information about the post-processing mode described at Step S104 includes the mode of stapling and the size of the sheet. It is noted that the specified time Tw needs to be set longer only when the staple mode is selected. If the flat stack mode in which the sheets are discharged without being subjected to alignment by the stapling tray or a proof discharge mode is selected, even when the stapler is in the staple-filling position because of staple empty, because the stapler does not need to move, the specified time Tw corresponding to the selected mode is used.

Because the image forming apparatus PR sets the timing to supply the sheet to the sheet post-processing device PD in this manner, efficient post-processing is implemented.

The present invention is not limited to the above-described embodiments and includes all the technical matters included in the technical idea described in the claims.

According to one aspect of the present invention, movement of a post-processing device and sheet supply timing are controlled appropriately so that efficient sheet processing is performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing system, the sheet processing system comprising:

a sheet processing device that includes a post-processing unit to perform post-processing on a sheet member and a control circuit to control a sheet supplying device that supplies the sheet member to the sheet processing device, wherein the post-processing unit has two waiting positions including a first position that is a normal waiting position and a second position that is a position filling items to be used in the post-processing in the post-processing unit, and when the post-processing unit moves from the second position to a post-processing position to perform the post-processing in response to a post-processing request, the control circuit sets a supply time for supplying the sheet member to the sheet processing device longer than a time that is required for the sheet processing device to move from the first position to the post-processing position by a predetermined time.

2. The sheet processing system according to claim 1, wherein the sheet supplying device sets the supply time when the post-processing request is a request for a preset post-processing.

3. The sheet processing system according to claim 1, wherein the post-processing is a stapling process, and the post-processing unit is a stapling unit that staples the sheet member.

4. The sheet processing system according to claim 1, wherein the predetermined time is equal to a time that is required for the post-processing unit to move from the second position to the first position.

5. The sheet processing system according to claim 4, wherein the sheet supplying device notifies the sheet processing device of the time that is required for the sheet processing device to move from the first position to the post-processing position and the time that is required for the sheet processing device to move from the second position to the first position.

6. The sheet processing system according to claim 5, wherein at least one of the time that is required for the sheet processing device to move from the first position to the post-processing position and the time that is required for the sheet processing device to move from the second position to the first position is changed depending on a mode of the post-processing.

7. The sheet processing system according to claim 5, wherein at least one of the time that is required for the sheet processing device to move from the first position to the post-processing position and the time that is required for the sheet processing device to move from the second position to the first position is changed depending on a size of the sheet member.

8. The sheet processing system according to claim 1, wherein the sheet supplying device is an image forming apparatus.

9. The sheet processing system according to claim 1, wherein the sheet supplying device is a sheet feeding device of an image forming apparatus.

10. A method of controlling a sheet supply in a sheet processing system including a sheet processing device that includes a post-processing unit that performs a predetermined post-processing on a sheet member and a sheet supplying device that supplies the sheet member to the sheet processing device, wherein the post-processing unit has two waiting positions including a first position that is a normal waiting position and a second position that is a position filling items to be used in the post-processing in the post-processing unit, and the method comprises setting, when the post-processing unit moves from the second position to a post-processing position to perform the post-processing in response to a post-processing request, a supply time for the sheet supplying device to supply the sheet member to the sheet processing device longer than a time that is required for the sheet processing device to move from the first position to the post-processing position by a predetermined time.

11. A computer program product comprising a computer-usable medium having computer-readable program codes embodied in the medium for implementing a method of controlling a sheet supply in a sheet processing system including a sheet processing device that includes a post-processing unit that performs a predetermined post-processing on a sheet member and a sheet supplying device that supplies the sheet member to the sheet processing device, wherein the post-processing unit has two waiting positions including a first position that is a normal waiting position and a second position that is a position filling items to be used in the post-processing in the post-processing unit, and the program codes when executed cause a computer to execute setting, when the post-processing unit moves from the second position to a post-processing position to perform the post-processing in response to a post-processing request, a supply time for the sheet supplying device to supply the sheet member to the sheet processing device longer than a time that is required for the sheet processing device to move from the first position to the post-processing position by a predetermined time.

* * * * *